US010544624B2

(12) United States Patent
Baker et al.

(10) Patent No.: US 10,544,624 B2
(45) Date of Patent: Jan. 28, 2020

(54) SYSTEM FOR A LOCK FOR A CLOSURE, A LOCK FOR USE WITH SUCH A SYSTEM, AND A CLOSURE SYSTEM

(71) Applicant: Automatic Technology (Australia) Pty Ltd, Keysborough (AU)

(72) Inventors: Geoffrey Baker, Keysborough (AU); Raymond Hawkins, Keysborough (AU); Serguei Pimenov, Keysborough (AU)

( * ) Notice: Subject to any disclaimer, the term of this patent is extended or adjusted under 35 U.S.C. 154(b) by 408 days.

(21) Appl. No.: 15/410,841

(22) Filed: Jan. 20, 2017

(65) Prior Publication Data

US 2017/0328130 A1 Nov. 16, 2017

(51) Int. Cl.
*G07C 9/00* (2006.01)
*E06B 9/80* (2006.01)
(Continued)

(52) U.S. Cl.
CPC ..... *E06B 9/80* (2013.01); *E05B 47/0012* (2013.01); *E05B 65/0021* (2013.01); *E06B 9/13* (2013.01);
(Continued)

(58) Field of Classification Search
CPC ..... E06B 9/80; E06B 9/00; E06B 9/00309; E06B 2009/804; E06B 2009/805;
(Continued)

(56) References Cited

U.S. PATENT DOCUMENTS 6,382,005 B1 5/2002 White et al.
6,666,054 B1 12/2003 Hsieh
(Continued)

FOREIGN PATENT DOCUMENTS

WO 99/53161 A1 10/1999
WO WO-9953161 A1 * 10/1999 ..... E05B 17/10

OTHER PUBLICATIONS

International Search Report and Written Opinion issued in corresponding international application No. PCT/AU2017/050444.
(Continued)

*Primary Examiner* — Munear T Akki
(74) *Attorney, Agent, or Firm* — DuBois, Bryant & Campbell, LLP; William D. Wiese

(57) ABSTRACT

A system for a closure lock comprises a battery-powered remote module with a lock mechanism for operating the lock, the remote module communicating with a base station coupled to a closure controller, the base station able to send lock control signals to the remote module to operate the lock. The module is arranged to have an operation mode and a non-operation mode, power consumption in the non-operation mode being lower than that in the operation mode, and is further configured to switch between the modes based on instructions from the base station. In the non-operation mode, the module maintains a communication link with the base station based on a pre-established synchronisation protocol.
The invention provides reliability against interference between base station and remote module, whilst greatly limiting the power consumption of the remote module.

22 Claims, 11 Drawing Sheets

(51) Int. Cl.

| | |
|---|---|
| ***E05B 47/00*** | (2006.01) |
| ***E05B 65/00*** | (2006.01) |
| ***E06B 9/13*** | (2006.01) |
| ***E06B 9/74*** | (2006.01) |

(52) U.S. Cl.
CPC ..... *E06B 9/74* (2013.01); *G07C 9/00309* (2013.01); *E05B 2047/002* (2013.01); *E05B 2047/0069* (2013.01); *E05B 2047/0072* (2013.01); *E06B 2009/804* (2013.01); *E06B 2009/805* (2013.01)

(58) Field of Classification Search
CPC ..... E06B 9/13; E05B 47/0012; E05B 47/026; E05B 65/0021; E05B 2047/002; E05B 2047/0058; E05B 2047/0067; E05B 2047/0069; E05B 2047/0072; E05B 2047/0094; G07C 2009/0038; G07C 2009/00928; G07C 9/00; G07C 9/00309; H04W 52/00; H04W 52/02; H04W 52/0203; H04W 52/0206; H04W 52/0209; H04W 52/0212; H04W 52/0219; H04W 52/0229; H04W 52/0235; H04W 52/0238; H04W 52/0261; H04W 52/0216
See application file for complete search history.

(56) References Cited

U.S. PATENT DOCUMENTS

| | | | | |
|---|---|---|---|---|
| 7,240,524 | B1 | 7/2007 | White et al. | |
| 9,284,775 | B2 † | 3/2016 | Pimenov | |
| 2012/0255231 | A1 | 10/2012 | Jenkins et al. | |
| 2014/0305599 | A1 * | 10/2014 | Pimenov | E06B 9/68 160/7 |
| 2017/0053467 | A1 * | 2/2017 | Meganck | G07C 9/00039 |
| 2017/0098335 | A1 * | 4/2017 | Payack, Jr. | G07C 9/00007 |

OTHER PUBLICATIONS

Yongwan Park, Fumiyuki Adachi, Enhanced Radio Access Technologies for Next Generation Mobile Communication, 2007, pp. 39-40, 1st edition, Springer Netherlands, Dordrecht, Netherlands.
Third Party Observation filed in corresponding international application No. PCT/AU2017/050444.
Yongwan Park, Fumiyuki Adachi, Enhanced Radio Access Technologies for Next Generation Mobile Communication, pp. 39-40, 2007 Springer, Dordrecht.†

* cited by examiner
† cited by third party

SYSTEM FOR A LOCK FOR A CLOSURE, A LOCK FOR USE WITH SUCH A SYSTEM, AND A CLOSURE SYSTEM

PRIORITY STATEMENT UNDER 35 U.S.C. § 119 & 37 C.F.R. § 1.78

This non-provisional application claims priority based upon prior Australian Patent Application No. 2016901828 filed on May 16, 2016, in the name of Geoffrey Baker, Raymond Hawkins and Serguei Pimenov entitled "Lock assembly, and control system for a lock," the disclosure of which is incorporated herein in its entirety by reference as if fully set forth herein.

FIELD OF THE INVENTION

The invention relates to a system for a lock for a closure, a lock for use with such a system, and a closure system. In particular, embodiments of the invention relate to a wireless garage door lock and a control system therefor, although the scope of the invention is not necessarily limited thereto. Aspects of the invention also relate to a closure system incorporating the lock assembly and/or the control system.

BACKGROUND OF THE INVENTION

Conventional powered door operators, such as garage door operators, include a motor and drive train assembly for moving the door. When the motor is energised (under control of the electronic controller of the operator), the drive train drives the door between its limit positions, i.e. between set open and closed positions. For security reasons, when the motor is turned off, it remains engaged with the garage door via the drive train, and the operator or its drive is designed to provide a locking function (e.g. through the use of a worm gear drive in the drive train, which prevents back driving). This serves to inhibit unauthorised movement of the garage door and thereby prevent unwanted opening.

However in some situations it is not sufficient to rely solely on the locking mechanism or function of the operator to securely lock a door. For example, in the case of roller garage doors, a certain degree of free rotation is possible if the door is forced open, as a portion of the door curtain wound on the stationary axle drum can partially unroll before further movement is prevented. This may be sufficient in some situations to allow entry. In the case of an overhead garage door, such as a sectional or tilt-up door, attempting to force open the door (e.g. by using a crowbar between the lower edge of the closed door and the ground) can cause deformation of one or more parts of the drive mechanism (such as to the door drive linkage or to the drive track), which can similarly result in unauthorised access risk. For security reasons, such a degree of movement for a door is not acceptable.

In other situations, the locking function of the operator or its drive may be unreliable or faulty, e.g. due to wear and tear. In these situations, it may be possible for an intruder to lift up a closed garage door even when it appears to be safely locked.

Whilst manual mechanical locking systems for closure assemblies are known, these can be of limited use, or can be less then reliable or difficult to maintain and/or install. Further, the user wishing to open the door needs to make the additional actions required to lock and unlock the door (such as getting out of her car), which is a significant inconvenience, meaning the door will often be simply left unlocked.

Electrically powered locks are also known, which may operate under control of the user or automatically under control of the operator controller, but have generally had limited adoption.

Further, wireless locking systems with independent power supply are also known, which avoid the need for electrical connection. However, these have generally met with limited success, as communication between a controller and known wireless locks can present various problems with regard to reliability, power consumption and signal interference.

WO 99/53161 teaches a remote controlled door lock, with a controller with an RF receiver which alternates between a wake mode and a sleep mode in order to conserve battery life. The controller is programmed to awake at regular intervals, check for an RF signals sent from a remote transmitter, move the lock bolt if a properly coded instruction sequence is received, and revert to sleep mode if not.

U.S. Pat. No. 6,666,054 also teaches a remote controlled door lock which includes one or more key-operated deadbolts and in which, as an additional security measure, when the deadbolts are unlocked it is necessary to use a remote control device to allow door latch release.

It is desirable to provide an improved control system for lock assemblies which overcomes or ameliorates one or more of the disadvantages or problems of the conventional art described above, or which at least provides the consumer with a useful choice.

In this specification, where a document, act or item of knowledge is referred to or discussed, this reference or discussion is not an admission that the document, act or item of knowledge or any combination thereof was at the priority date: (a) part of common general knowledge; or (b) known to be relevant to an attempt to solve any problem with which this specification is concerned.

SUMMARY OF THE INVENTION

According to one aspect of the invention, there is provided a system for a lock for a closure, the system comprising a remote module having or associated with a lock mechanism for operating the lock, the remote module having a communication unit configured to communicate with a base station coupled to a controller of the closure, the base station able to send lock control signals to the remote module to operate the lock, the remote module being arranged to have at least an operation mode and a non-operation mode, in which power consumption of the remote module in the non-operation mode is lower than that in the operation mode, the remote module being configured to switch between non-operation and operation modes based on instruction from the base station, and wherein, in the non-operation mode, the remote module maintains a communication link with the base station based on a pre-established synchronisation protocol.

In a preferred form, the remote module is arranged to have at least three modes of power usage, including:

the operation mode in which the communication unit is active for two-way communication with the base station, and the lock mechanism can be actuated to operate the lock, a first non-operation mode being a standby mode, in which the communication unit is active only to receive communications from the base station;

a second non-operation mode being a sleep mode, in which the communication unit is inactive; and wherein the remote module is configured to switch between the operation mode, standby mode and sleep mode in accordance with the pre-established protocol.

In one form, the above-defined system is for use with a base station configured to transmit first synchronisation signals at first prescribed intervals, wherein the remote module is programmed such that, when in sleep mode, it switches for a preset duration to the standby mode at or substantially at the first prescribed intervals to detect the synchronisation signals, thereby to monitor a communication link between the base station and the remote module.

In accordance with the invention, the remote module can remain in its sleep mode (i.e. its lowest power mode) for almost all of the time, switching to said standby mode only at said first prescribed intervals to check for an expected signal from the base station to confirm communication synchronisation. If the received signal contains particular data, then the remote module can switch into operation mode for two-way communication and to operate the lock in accordance with received signals.

The particular data is, for example, a command from the base station to drive the closure.

Operation of the lock may involve releasing the lock from a locked condition (e.g. against the action of a spring) or the lock mechanism may be a drive mechanism, to drive the lock between a locked condition and an unlocked condition.

In the operation mode, the remote module is thus able to receive lock operation signals and, accordingly, to operate the lock (e.g. to drive the lock between the locked and unlocked conditions). Once the lock is operated (e.g. driven to its required position, either locked or unlocked), the remote module switches back to sleep mode.

Said synchronisation signals are preferably coded. They may contain data concerning the identity of the base station, and/or concerning the status of the controller. Said signals may be packetised digital signals.

Preferably, successive synchronisation signals are sent in accordance with a pseudo-random frequency hopping pattern. Said communication unit and said base station are therefore configured to support a frequency hopping communication protocol. Further, successive synchronisation signals may be sent in accordance with a pseudo-random code hopping pattern.

The remote module may be configured such that, if it does not detect a synchronisation signal from the base station, a request signal is sent to the base station requesting re-transmission of a synchronisation signal.

The base station is configured to send a further synchronisation signal to the remote module following receipt of the request signal. Once the synchronisation signal is received by the remote module, the remote module is configured to revert to sleep mode for substantially the remainder of the prescribed interval.

Preferably, the remote module is configured such that, if no synchronisation signal is received within a set time period from sending said request signal, one or more further request signals are sent and, upon failure to receive a synchronisation signal, the remote module commences a resynchronisation procedure to re-establish synchronised communication with the base station.

The re-synchronisation procedure may take any appropriate form, for example, it may involve a process which re-establishes timing of the remote module and which re-establishes a pseudo-random frequency hopping pattern stored at both the base station and the remote module.

The communication between the communication unit of the remote module and the base station may take any suitable form. Preferably, it is radio frequency communication. Alternatively, it may be infrared communication.

The timing control of the switching of the remote module between modes may be provided by a remote module timer. The remote module may be configured such that, upon detection of a synchronisation signal from the base station, the timing of the transmission is used to adjust the remote module timer.

Said remote module check signals may be coded, and may contain information concerning the identity of the remote module. Successive synchronisation signals may be sent in accordance with a pseudo-random frequency hopping pattern.

The above system may include a base station for communicating with the communication unit of the remote module, wherein the remote module is configured to transmit remote module check signals at second prescribed intervals, and wherein the base station is configured to detect said remote module check signals at or approximately at said second prescribed intervals.

The base station may be configured such that, when it receives a remote module check signal, it transmits a confirmation signal, and if this confirmation signal is received by the remote module within a prescribed time period from the sending of the remote module check signal, the remote module switches to said sleep mode.

The remote module is preferably configured such that, if it does not receive the confirmation signal within the prescribed time period, it transmits one or further check signals to be received by the base station. The base station is preferably configured such that, if it fails to detect one or more remote module check signals, a resynchronisation procedure to re-establish communication between the base station and the remote module is initiated.

In this way, if no confirmation signal is received by the remote module within a set time or a prescribed number of instances of sending check signals, the resynchronisation procedure is initiated.

Each of said first prescribed intervals may be one repeated time interval and, preferably, each of said second prescribed intervals may be a multiple of said first time intervals.

Preferably, if the remote module receives a signal from the base station signifying a particular closure controller status (such as a status indicating that a door open or close command has been received by the controller), the remote module switches to the operation mode.

The particular controller status may include a door opening status in which a door opening command signal from a user operable device has been received by the controller, and a door closing status in which a door closing command signal from a user operable device has been received by the controller.

The remote module may be configured to transmit a signal to said base station concerning the status of the lock, to be stored by the base station as a particular lock status (locked or unlocked status). The lock status may be checked on receipt of a command signal before the controller can operate the closure.

In one preferred form, the lock is configured to drive between a locked and an unlocked (released) condition, wherein, when the lock departs from its locked or its unlocked condition, a signal is transmitted by said remote module to said base station and stored as a different lock status (intermediate status).

Preferably, the lock is provided with a manual lock operator, i.e. means for selective manual operation of the lock between said locked and unlocked condition.

The manual lock operator may be a handle which operates the lock mechanism, or may be a push button or switch whose operation instructs the lock to operate the lock mechanism. For example, each operation of said push button or switch may move the lock into its locked condition, if it is unlocked, or into its unlocked condition, if it is locked.

The system may be configured such that, if the manual lock operator is operated and the remote module is not in its operation mode, the remote module switches into operation mode and transmits a signal to said base station to be stored as a lock status.

As discussed above, in the operation mode, the lock mechanism operates (e.g. the drive mechanism is activated to drive the lock from the locked condition to the unlocked condition, and back), in accordance with control signals received from the base station. Once the lock is operated (e.g. driven to its required position, either locked or unlocked), the remote module switches back to sleep mode.

Further, the system may be configured such that, if the base station sends a lock control signal to the remote module to operate the lock, and does not receive a corresponding lock status update within a prescribed time, a prescribed action is performed. This may include sending a further lock control signal, moving the closure in a prescribed manner, and/or providing a prescribed alert signal to prompt further action (for example, to prompt a further use of the user operable device to provide a command signal).

The remote module is preferably configured to transmit information concerning the status of its power source. This information may be received by and stored at the base station as a remote module power status.

The control system may be configured to control two or more locks. In one embodiment, a remote module is coupled to each lock for independent communication with, and control by, the base station. In another embodiment, a remote module is coupled to each lock and the remote modules are configured in a master and slave relationship. In this configuration, one of the remote modules on a master lock may be configured as a master remote module, and the remote modules on the other lock(s) may be configures as slave remote modules. The base station may directly communicate with, and control, the master remote module; and the master remote module may directly communicate with, and control the slave remote modules.

When two or more locks are used, the sending of said synchronisation signals from the base station for each lock may be interleaved. In other words, time allocation is used in maintaining communication between the base station and each lock. Alternatively, frequency or code allocation may be used.

In a further form, the present invention provides a system for a lock for a closure, the system comprising:

a remote module having or associated with a lock mechanism for operating the lock, the remote module having a communication unit and a replaceable power source which powers the lock mechanism and the communication unit; and a base station coupled to a controller of the closure, and configured to communicate with the communication unit, the base station being programmed such that, when initiated, it determines the presence of the communication unit of a remote module in which said replaceable power source is present and establishes a synchronised communication link therewith.

In a further form, the invention provides the system as defined in any of the aspects above, in combination with a closure system (such as a garage door system), to enable locking of said closure in a closed position by way of the lock mechanism.

In a further form, the present invention provides a lock for use with the system as defined in any of the aspects above, for operating to lock a closure provided in a fixed structure, the lock mountable on the closure itself, for interaction with a part of the fixed structure. The fixed structure may be a part of a track in which the closure travels, or may be a wall or other structure in which the closure is formed, or may be a strike plate fixed to the track or other structure.

In a further form, the present invention provides a closure system including two locks for use with the system defined above, the locks for use on opposed sides of a closure to prevent movement of the closure, wherein the locks are of like form and one is inverted so that its lock mechanism operates for locking action in the opposite direction to the other.

In a further form, the present invention provides a lock for a closure, the closure running in or along a track between an open and a closed position, and the lock having an operating mechanism for driving the lock between a locked condition and an unlocked condition, wherein the lock is configured for direct mounting to said track by a mounting system and to selectively prevent movement of the closure, such that said mounting system does not interfere with the running of the closure in the track.

This allows the lock to be used in situations where mounting it to a wall or other structure is not convenient or practicable.

Where the track takes the form of a channel on the inside of which the edges of the closure run, the lock is preferably mounted to the outside of the channel. The track may include an aperture through which a bolt of the lock passes, so to prevent movement of or to interact with the closure. Preferably, a suitable shaped strike plate is provided on the closure for cooperation with said bolt.

In a further form, the present invention provides a lock for a roller door closure, the roller door having a corrugated form and running in or along a track between an open and a closed position, and the lock having an operating mechanism for driving the lock between a locked condition and an unlocked condition, wherein the lock is configured for mounting on or adjacent to said track to selectively prevent movement of the closure, the lock having a bolt which in said locked condition is positioned between corrugations of the roller door.

Garage doors and other closures operate in what can be very tough environments, exposed to the extremes of outdoor environments, and wired devices are relatively vulnerable to such conditions. Moreover, wired devices require relatively costly and complex installation and maintenance, and give rise to significant inconveniences. On the other hand, wireless devices require independent power sources which need to be replaced regularly.

Against this background, the present invention provides the possibility of reliable and secure wireless locks.

In particular, the invention affords very high reliability against interference, whilst greatly limiting the power consumption requirements of the wireless elements.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE DRAWINGS

Door Drive System

Figure 1:
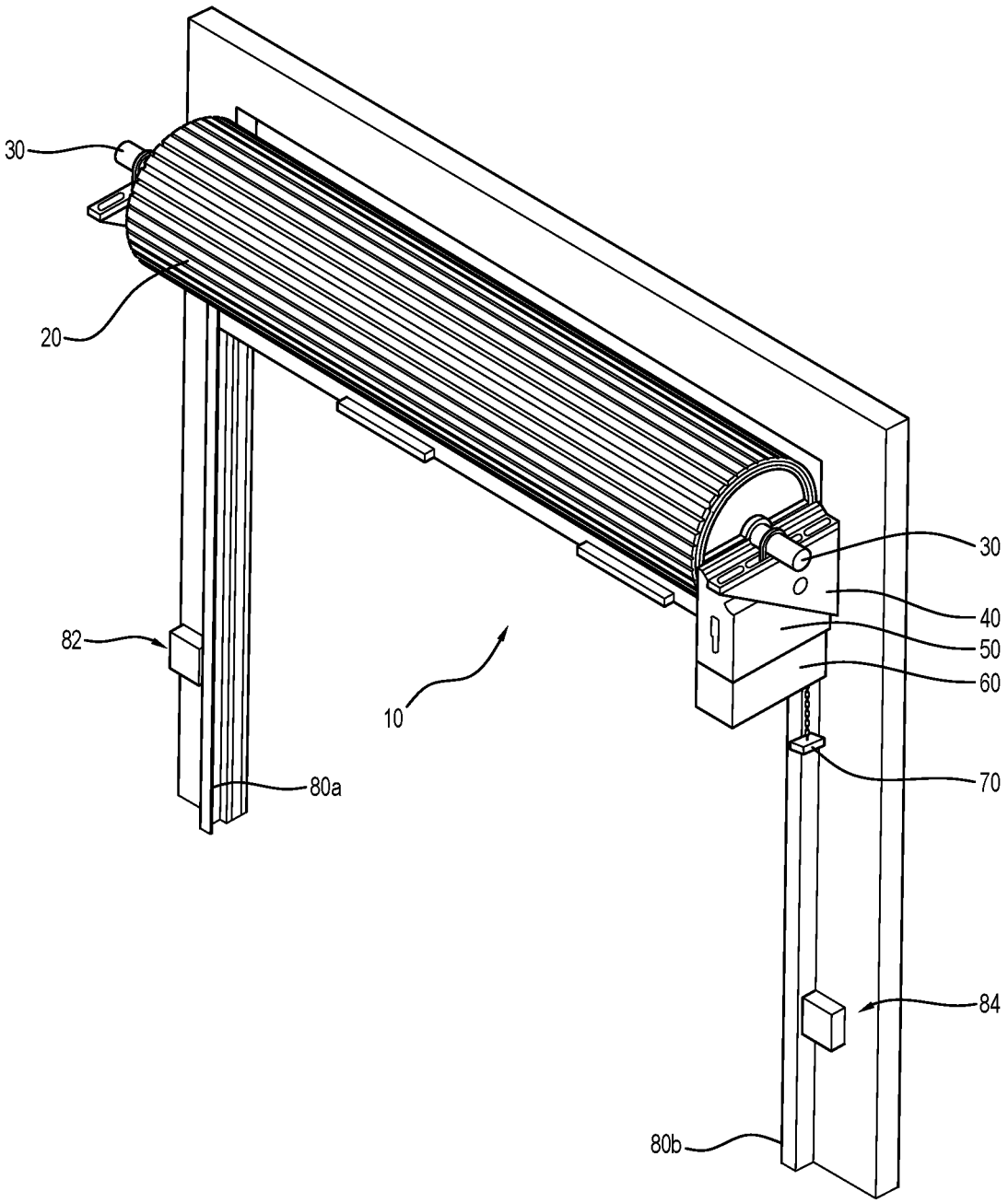
FIG. 1 illustrates an installed garage roller door system.

The roller door system 10 of FIG. 1 includes a drum-mounted roller door 20 on a support carried by an axle 30 mounted to two end brackets 40. At one end of axle 30 is mounted an operator 50 including a motor (not shown) and a drive train (not shown), as well as an electronic controller 60. Operator 50 is provided with a disengagement pull handle 70 to allow disengagement of the drive train from roller door 20 if manual operation of the door is required at any time.

Although FIG. 1 shows a roller door system, it will be understood that the concept described herein is equally applicable to overhead doors (such as tracked tilt-up and sectional doors), shutters, curtains, gates or any other type of movable closure or barrier.

Figure 3:
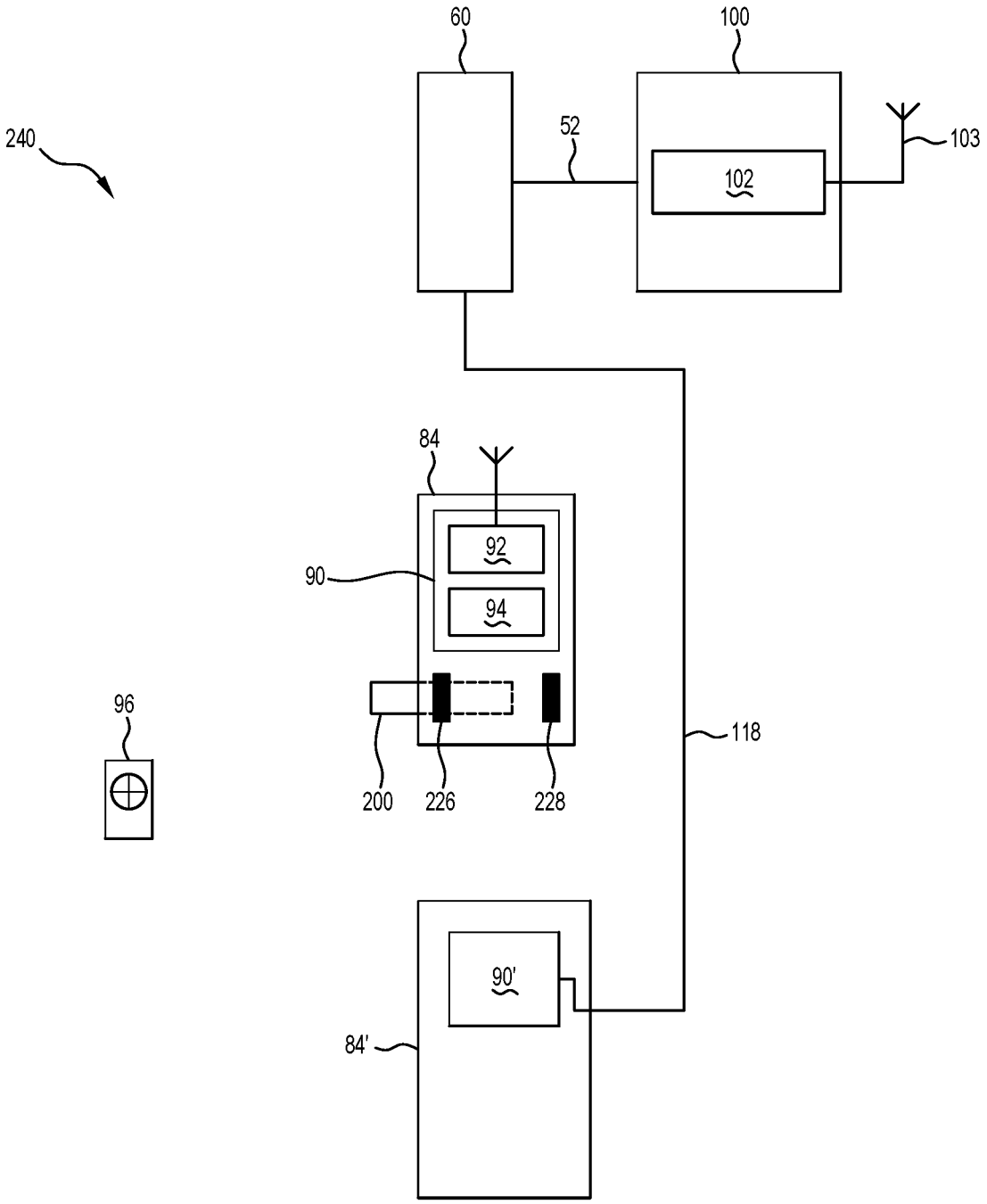
FIG. 3 is a schematic diagram of a control system for the lock assembly of FIGS. 2A to 2C according to an embodiment of the invention.

Controller 60 includes one or more control boards with programmable microcircuitry to manage the various functions of the system, and includes or is coupled to a radio receiver for receiving radio control commands from a user's remote control transmitter device (96, FIG. 3).

Opposed roller tracks 80*a*, 80*b* guide the travel of the door 20 between open and closed positions. A wireless lock assembly 84 is mounted to or adjacent to one of the roller tracks 80*b* and a second wireless lock assembly 82 mounted to or adjacent to the opposed roller track 80*a*. RF wireless communication between a base station connected to or integrated into controller 60 and the lock assemblies allows operation of the locks—under the control system of the invention—to selectively allow and prevent movement of door 20.

In discussing of the control system, the description below concerns an embodiment in which a single lock assembly 84 is used. However, it will be understood that the control system may also be implemented with two lock assemblies 82, 84 (or with any number of lock assemblies) in a similar manner in which a base station communicates with and controls operation of both lock assemblies independently (discussed further below). Alternatively, the lock assemblies 82, 84 may be arranged in a master/slave configuration in which a base station directly communicates with and controls one of the lock assemblies 84, and the lock assembly 84 communicates with and controls the second lock assembly 82.

Lock Assembly

Figure 2A:
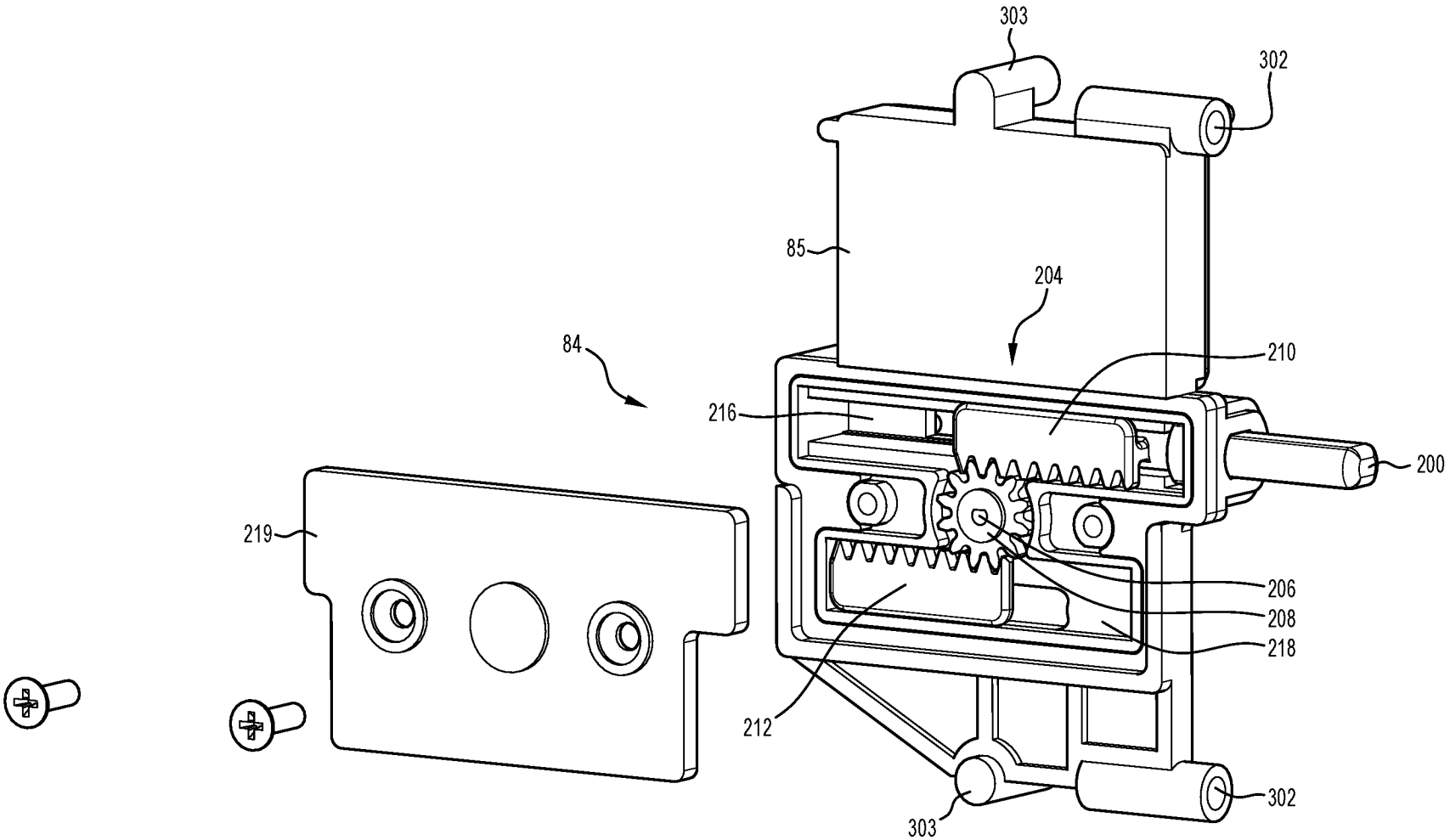
FIG. 2A is a first, rear, view of a lock assembly, partially disassembled, configured for control by a control system according to an embodiment of the invention.
Figure 2B:
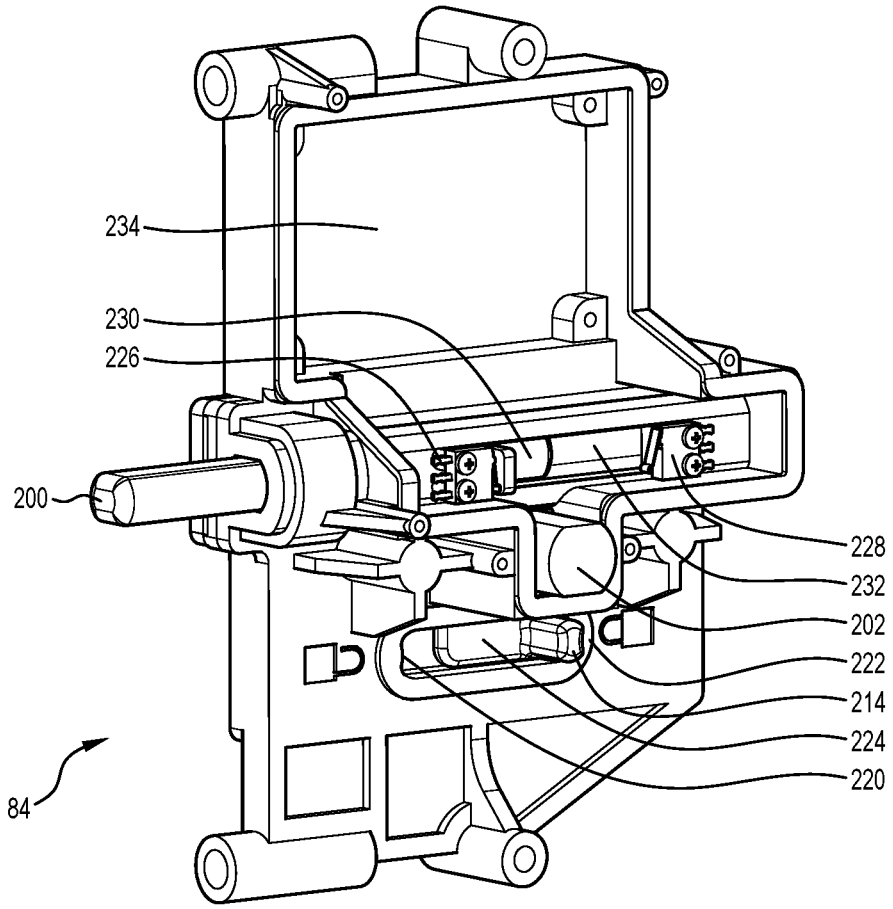
FIG. 2B is a second, front, view of the lock assembly of FIG. 2A (with cover housing removed)

As shown in FIGS. 2A and 2B, lock assembly 84 includes a locking bolt 200 driven by a motor 202 via a rack and pinion gear assembly 204. Lock assembly 84 includes a base part 85 which provides the rear of the lock assembly, configured to support the components described below, base part 85 including bores 302, 303 allowing mounting of the assembly in different configuration, as discussed further below.

As illustrated in FIG. 2A, a pinion gear 208 is mounted to the output shaft 206 of motor 202, to engage with a first rack gear 210 mounted to run in a linear slot 216 and fixedly connected to the locking bolt 200, and a second rack gear 212, mounted to run in a further, parallel linear slot 218, is provided with a manual override handle 214 which projects to the front of the assembly through a slot 224 (FIG. 2B). The manual override handle 214 is slidable between opposite ends 220, 222 of slot 224. The first rack gear 210 and the second rack gear 212 are mounted on opposing sides of the pinion gear 208 such that rotation of the pinion gear 208 causes linear movement of the first and second rack gears 210, 212 in mutually opposed directions within their respective slots 216, 218.

With reference to FIG. 2A, when the motor 202 is activated to rotate the pinion gear 208 in a clockwise direction, the locking bolt 200 is extended and thus moved into its locked position. At the same time, the second rack gear 212 is moved in an opposite direction causing the handle 214 to slide to end 222 of the slot 224. Conversely, when the motor 202 is activated to rotate the pinion gear 208 in an anti-clockwise direction, the locking bolt 200 is withdrawn and thus moved into its unlocked position (not shown). At the same time, the second rack gear 212 is moved in an opposite direction causing the handle 214 to slide to opposite end 220 of the slot 224.

When it is desired to manually operate the locking bolt 200 (generally, only in emergency situations, such as in conditions of power failure or a dead battery), handle 214 can be moved between the ends 220, 222 of the slot 224 to move the locking bolt 200 (via pinion gear 208) between its unlocked and locked positions.

As shown in FIG. 2B, limit switches 226, 228 are provided at opposite ends of a slot 232 to detect the extreme positions of locking bolt 200. More specifically, the locking bolt 200 includes a radial protrusion 230 received within and configured to travel along slot 232, protrusion 230 fixed to bolt 200. As bolt 200 moves to its extended (i.e. locked) position, protrusion 230 moves to one end of slot 232 to activate limit switch 226. As bolt 200 moves to its withdrawn (i.e. unlocked) position, protrusion 230 moves to the opposite end of slot 232 to activate limit switch 228. The activation of limit switches 226 and 228 is used to provide an electrical status signal to indicate if locking bolt 200 is in its locked or unlocked position. If neither limit switch is activated, bolt 200 is deemed to be in a third, intermediate, position.

As FIG. 2A shows, a rear cover plate 219 is provided, to be fastened by screws to base part 85 of the lock assembly, so to cover and protect the mechanical components of the lock. Front housing 236 (not shown in FIG. 2B) is discussed further below.

The lock assembly 84 further includes a recessed portion 234, accessed from the front of the device, for housing one or more printed circuit boards (PCBs) and an on-board power source (2×C batteries). The PCBs provide lock control and drive circuitry 94 for operating motor 202 and a remote communications unit 92 for communicating with a base station transceiver 102 associated with controller 60, as discussed further below with reference to FIG. 3.

Mounting of Lock Assembly to Door

Figure 2C:
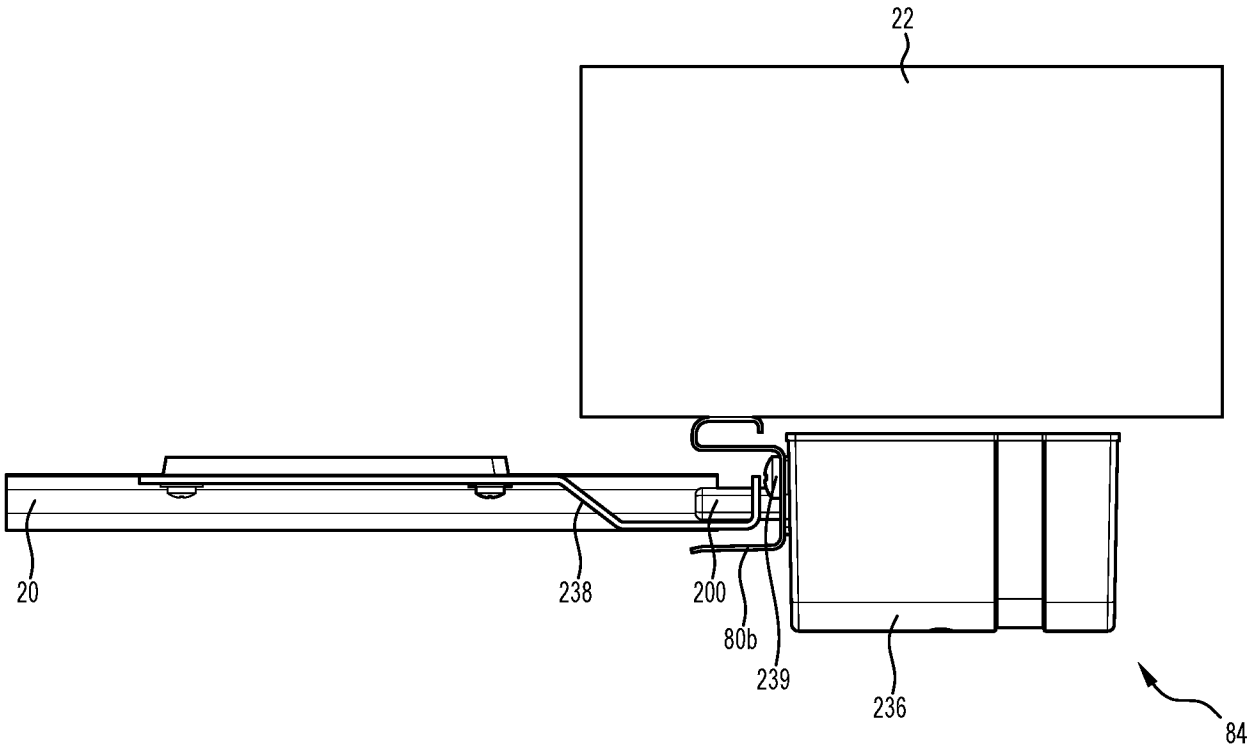
FIG. 2C illustrates the mounting of the lock assembly of FIGS. 2A and 2B to a track of the garage roller door system shown in FIG. 1.

FIG. 2C shows a cross sectional view of roller door 20, roller track 80*b* and garage wall 22, the section taken above the position of mounting of the lock assembly. The lock assembly 84 includes a removable outer front housing 236 which covers and protects the components shown in FIG. 2B including batteries and PCBs, and is mounted directly to the outer lateral side of door track 80*b*, by way of screws 239 passing from within track 80 b through apertures in the track to engage with the two lateral threaded bores 302 of base part 85 of the lock assembly. A further aperture is provided in track 80*b* through which bolt 200 can pass. When the lock is in its locked position as shown, bolt 200 extends through an opening in a strike plate 238 mounted to door 20, to thereby prevent movement of the door. It will be appreciated that the positioning, shape and size of the heads of screws 239 is selected to avoid interference with the movement of the side edges of door 20 in track 80*b*.

Alternatively, lock assembly 84 may be mounted to wall 22 by bolts passing through the two bores 303 normal to the plate of base part 85 of the assembly. Again, an aperture is then provided in track 80*b* for travel of bolt 200.

Typically, the lock assembly 84 may be arranged approximately 1-2 m above the floor so that the emergency manual override handle 214 of the lock is within easy reach of a user, and for convenience of changing the batteries and other maintenance as required. As will be understood, removal of cover housing 236 allows access to the batteries and to the handle 214.

When used with an overhead door, such as a sectional or tilt up door having lateral wheels engaging in a track to guide the movement of the door, the lock may be positioned such that, when the door is closed, bolt 200 engages just above a wheel, preferably the lowermost wheel. In this form, no strike plate or other addition or modification to the door assembly is required.

Figure 10:
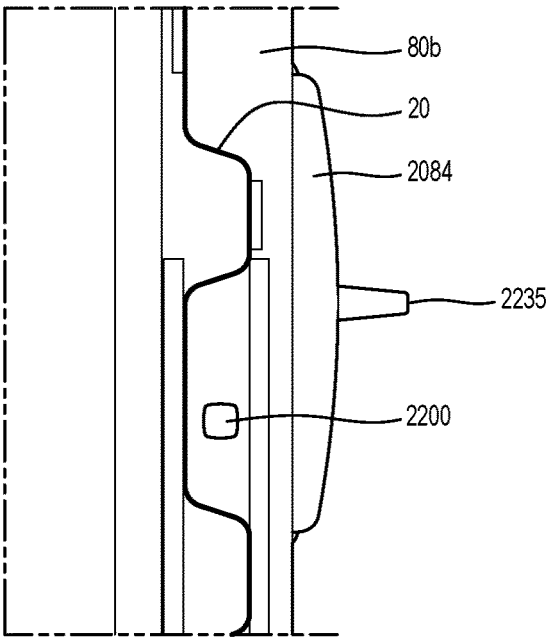
FIGS. 10 and 11 illustrate alternative ways of mounting the lock assembly of FIG. 9 to a garage roller door track.
Figure 11:
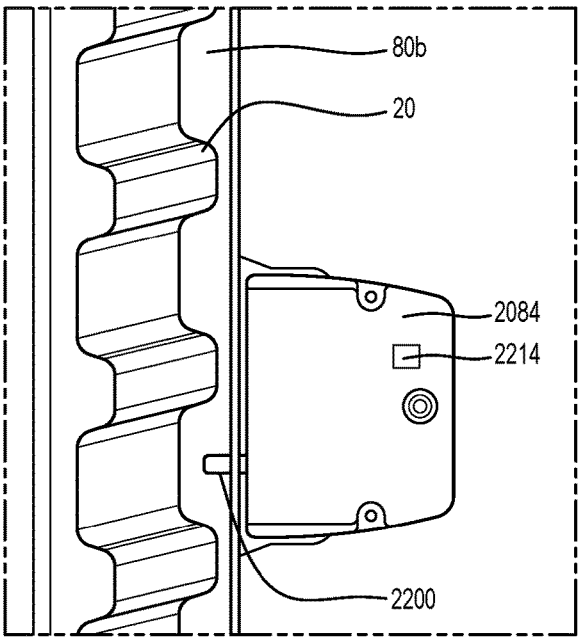

When used with a roller door, locking may be accomplished without the need for a strike plate on the door, as the lock bolt when extended is positioned between corrugations of the door curtain. An example is illustrated in FIG. 10, with the lock assembly positioned on the outside of track 80*b*, laterally of the track (mounted either to track 80*b* or to wall 22, such that bolt 2200 projects between corrugations of the door curtain, so allowing only very limited movement of door 20. FIG. 11 illustrates an alternative embodiment, with the lock assembly mounted to the front face of track 80*b* (either directly, or by way of a mounting bracket fixed to wall 22), such that the bolt moves in a direction normal to the plane of door 20. Once again, when bolt 2200 is extended, it projects between two successive corrugations of the door curtain, so allowing only very limited movement of door 20.

Lock Control System

As diagrammatically shown in FIG. 3, the components of the control system 240 for the lock include a remote module 90 and a base station 100, the latter coupled to the door operator controller 60. The remote module 90 is provided by the PCBs housed in recessed portion 234 of the lock assembly 84, and comprises a communications unit 92 in the form of an RF transceiver with microprocessor control. Remote module 90 further comprises the lock circuitry 94 for operating the motor 202 based on instructions received by the communications unit 92.

The controller 60 of door operator 50 is connected by lead 52 to a base station 100, which comprises an RF transceiver 102 with microprocessor control and an antenna 103. RF transceivers 92 and 102 are designed to communicate with one another by way of a suitable communications protocol, as will be understood by the skilled reader.

It will be understood that base station 100 may alternatively be integrated into door operator 50, for example the microprocessor of the RF transceiver 102 may be integrated into operator controller 60.

Hence, although in accordance with this description the control logic for communicating with and issuing control commands to remote module 90 is programmed into base station 100, it could equally be programmed wholly or partly into controller 60.

In a further alternative embodiment, the system may be provided with an optional wired lock assembly 84' for installation in the event that there is unacceptably high RF interference at the installation location.

The wired lock assembly 84' comprises a remote module 90' that connects via a core interface link 118 to door controller 60. Signals between controller 60 and remote module 90' therefore travel directly via link 118 rather than wirelessly between base station 100 and remote module 90, but otherwise the operation of this variant is identical to the control system for a wireless lock assembly 84 as described herein.

As discussed in further detail below, in order to minimise power consumption, the remote module 90 of the lock assembly is configured to have (at least) three modes of power usage, namely: an operation mode in which the communication unit 92 is operational for two-way communication with RF transceiver 102 and lock circuitry 94 is operational (for conditions in which the lock bolt can be driven by motor 202 between its locked and unlocked positions); a standby mode in which communication unit 92 is active only to receive signals from RF transceiver 102, and a sleep mode in which communication unit 92 is inactive.

In response to a command signal (e.g. from a user operable remote control transmitter 96) received by the controller 60 to open or close the door 20, the transceiver 102 transmits a signal to switch the remote module 90 into its the operation mode. In the operation mode, in accordance with control signals received by communications unit 92, the lock circuitry 94 operates motor 202 to move the locking bolt 20 into its locked or unlocked positions. Detailed operation of the remote module 90 in the operation mode will be explained in further detail with reference to FIGS. 6 and 7.

In operation mode, lock circuitry 94 switches power to motor 202 in the appropriate direction to drive bolt 200 between its first, locked position and its second, unlocked position. In this embodiment the bolt has a travel time of 700 ms.

When the door is locked (i.e. the bolt is in its first, locked position), the base station has the status of the lock flagged as STATUS 1. When the user sends a command to open the door to controller 60, an UNLOCK signal sent by base station 100 is received by communications unit 92, lock circuitry 94 commences operation, and the de-energising of microswitch 226 results in a signal being sent from communications unit 92 to base station 100, which logs the status of the lock assembly is in its third, intermediate position (STATUS 3). When it reaches its second, unlocked position microswitch 228 is energised and a signal is sent from communications unit 92 to base station 100, which logs the status of the lock (STATUS 2). Remote module 90 then switches into non-operation mode. Controller 60 is then able to drive the door to its open position.

However if that (unlocked position) signal has not been received within 700 ms (or a slightly longer time period, to allow for any signal transmission delay and processing and some tolerance in the operation of the lock mechanism) this is deemed to be an error, and controller 60 is not able to drive the door. Again, remote module 90 switches into non-operation mode. A prescribed alert or warning can be issued by the controller (e.g. the operator sounds an audible beep). If a further (door open) command signal is received from the user, the remote module switches into its operation mode, and the operation of the lock (to drive it into its unlocked position) is attempted again. Alternatively, the system can be programmed to command the lock to attempt to unlock more than once without receipt of a new command signal, if desired.

Conversely, when the door is unlocked (i.e. the bolt is in its second, unlocked position, and the door is open), the base station has the status of the lock flagged as STATUS 2. When the user sends a command to close the door to controller 60 (or an autoclose function operates), the lock status is checked, and controller 60 drives the door to its closed position. When it reaches that position (by attainment of the door closed limit position, signalled to the controller 60 e.g. by the door's position encoder system), a LOCK signal is sent by base station 100 to communications unit 92, lock circuitry 94 commences operation, and the de-energising of microswitch 228 results in a signal being sent from communications unit 92 to base station 100, which logs the status of the lock assembly is in its third, intermediate position (STATUS 3). When it reaches its first, locked position microswitch 226 is energised and a signal is sent from communications unit 92 to base station 100, which logs the status of the lock (STATUS 1). Remote module 90 then switches into non-operation mode.

Again, if that (locked position) signal has not been received within 700 ms (or a slightly longer time period, to allow for signal transmission and processing and some tolerance in operation of the lock mechanism) this is deemed to be an error. Again, remote module 90 switches into non-operation mode. A prescribed alert or warning can be issued by the controller (e.g. the operator sounds an audible beep). Only when a further door open command signal is received from the user does the remote module switch into its operation mode. A further door close command signal does not result in a further attempt to drive the lock into its locked position.

Alternatively, if desired, the system can be programmed such that a further door close command signal does result in the lock again attempting to move into its locked position, or such that it attempts to lock more than once without receipt of a new command signal.

Thus, to minimise power consumption, the remote module 90 is only in its operation mode when operation of the lock is required as a result of a user command, or when it detects that the position of bolt 200 has changed as a result of manual operation. Remote module 90 has built into it the following logic:

- Logic functions which enable it to respond as required to received signals so to drive motor 202 via lock circuitry 94.
- Logic functions to receive signal from microswitches 226 and 228 and transmit those signals by way of communications module 92 to base station 100.
- Logic functions to switch communications module 92 between its different modes of operation, in accordance with the protocols discussed below.

The logic is such that, if the lock is manually operated by way of handle 214, then (due to the operation of microswitches 226 and 228) remote unit 90 switches into operation mode to send a signal to base station 100, which will flag the new status of the lock. Remote unit 90 switches back into non-operation mode.

To limit power usage, the remote module 90 is not equipped with decision-making logic to enable it to interpret the lock condition or to take any action in response thereto; that is all done by base station 100.

Other logic required for safe operation of the lock assembly 84 is also provided by base station 100.

In an alternative form remote module 90 may include logic allowing local decisions to be made regarding operation of the lock, but to minimise power requirements this is generally not a preferred option.

If the lock is manually operated while the door is moving this can result in damage (for example, if the door is in the process of closing and the lock is manually moved out of its unlocked position). In this situation the resulting signal sent to base station 100 to change lock status will stop the door movement, and a suitable alert or other signal provided (e.g. the operator provides a number of audible beeps to indicate the interference to the operation of the door). On receipt of a further command signal, the lock is moved into its unlocked position and door travel can continues.

If the door is locked, and the lock is manually operated into its unlocked condition, then the system is not programmed to attempt to re-lock the door. This situation could arise when the door operator is not functional (e.g. in a power outage) and the user wishes to disengage the door drive and manually open the door. In this situation, subsequent locking will only happen once the door has been operated again and returned to its closed position.

Further, when the controller is accessed to run diagnostics (i.e. by a technician), then the system is programmed to move the lock into its unlocked position and maintain it in that position until the diagnostics mode is exited, as the technician may wish to manoeuvre the door (e.g. to reset limit positions) without hindrance of door locking.

When not in its operation mode, the remote module 90 switches between the sleep mode and the standby mode (as described in further detail below with reference to FIGS. 4 and 5). In the non-operation mode, power consumption of the lock assembly 84 is minimised, so to conserve battery life.

The battery voltage of lock assembly 84 is transmitted by way of a coded signal to base station transceiver 102 and relayed to controller 60 as a BATTERY STATUS value whenever remote module 90 switches into operation mode.

If the battery voltage drops below a prescribed level, the BATTERY STATUS value is set at LOW, and an appropriate alert provided by the operator (e.g. the operator light executes a prescribed sequence or number of flashes (and/or audible alert) at the end of each door operation). If desired, the system may be programmed such that the door operator is disabled (i.e. further driving of the door other than by manual operation will be prevented until the batteries are replaced).

Further, controller 60 may be programmed such that, if an attempt is made to use it to operate door 20 when there is no communication between base station 100 and lock assembly 84, the door will not operate, and a suitable signal or alert may be provided by the operator or to the user by another means.

In accordance with the invention and the communications protocol used and described in detail below, remote module 90 of the lock assembly has three modes of power consumption, namely:

- an operation mode (highest power consumption), in which communication unit 92 is operational to send and receive signals to and from RF transceiver 102, and in which lock circuitry 94 is operational, such that lock bolt 200 can be driven by motor 202 between its locked and unlocked positions;
- a non-operation mode (lower power consumption, 'standby mode'), in which communications unit 92 is only able to receive signals from RF transceiver 102; and
- a further non-operation mode (lowest power consumption, 'sleep mode'), in which communication unit 92 is inactive, with only its system watchdog timer consuming power.

| | |
|---|---|
| Operation mode | Two-way communication by unit 92<br>Lock circuitry 94 can operate |
| Non-operation mode - standby | Unit 92 able to receive signals only<br>Lock circuitry 94 non-operational |
| Non-operation mode - sleep | Unit 92 inactive (watchdog timer only)<br>Lock circuitry 94 non-operational |

Communications Protocol Between Base Station and Remote Module

When not in its operation mode, a short burst coded synchronisation signal (having an on-air duration of about 50 μs) is transmitted in a suitable RF band from base station transceiver 102 at a regular interval (100 ms), and RF transceiver 92 is switched from the sleep mode into the standby mode for a short period at that same interval in order to monitor that synchronisation signal. When the synchronisation signal is received, the wireless system is therefore assured that remote module 90 is in communication with the base station 100, and the microprocessor of RF transceiver 92 adjusts its internal clock data in accordance with the termination of the short burst synchronisation signal, to avoid any timing synchronisation drift relative to the internal clock of the microprocessor of the base station transceiver. RF transceiver 92 then switches off, toggling the wireless system back into sleep mode until the next scheduled transmission. In this way, remote module 90 continuously retains its synchronisation with base station 100, without having to transmit any signals.

Having regard to the duration of signal transmissions used in the preferred embodiment, the effective timing of a signal transmission (Tx)/receipt (Rx) is about 400 μs. For signal receipt, this includes time for tuning the relevant transceiver to a specified frequency (taking about 130 μs). In addition, at least about 25 μs either side of a transmission may be incurred due to time shifting issues. Further time may be needed for longer signals. Similar issues apply with regard to signal transmissions which need to include additional time to account for the on-air duration of 50 μs (the duration generally used for all transmissions), plus other relevant provisions.

The operative interaction between the RF transceiver 92 and the base station transceiver 102 is described below with reference to FIGS. 4 and 5 which show respective logic algorithms (at remote module, logic 300 and at the base station, logic 400 respectively) of the process.

Figure 4:
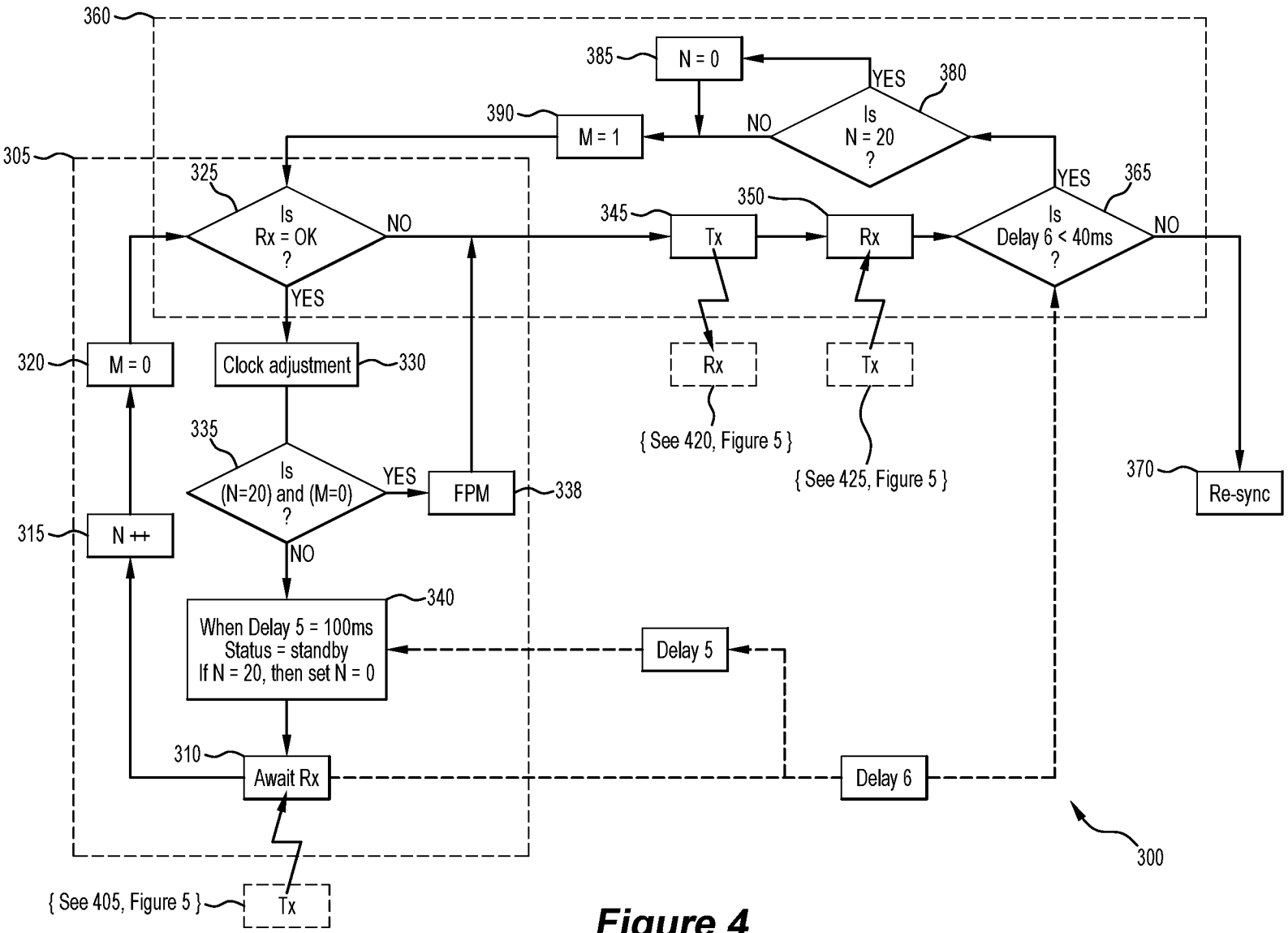
FIG. 4 is a logic flow diagram illustrating the synchronisation process implemented for the communication unit of the control system shown in FIG. 3.

FIG. 4 diagrammatically shows logic algorithm 300 implemented by RF transceiver 92 for carrying out the process of this embodiment of the invention. Algorithm 300 comprises two main sub-processes (305 and 360) which define core operating procedures of the RF transceiver 92 when in sleep mode. Sub-process 305 represents the primary iterative synchronisation maintenance procedure carried out every 100 ms (referred to as 'Delay 5') between the base station transceiver 102 and RF transceiver 92, and sub-process 360 represents a protective resynchronisation procedure (referred to herein as 'forced protective mode', or FPM) executed following completion of a predefined number of iterations of sub-process 305 (in this embodiment, following completion of the 20th iteration of sub-process 305 triggered by 338), or as a default protective resynchronisation procedure when scheduled communications from the base station 100 are not timely received.

Sub-process 305 begins at event 310 where receipt of the short burst coded synchronisation signal transmitted from the base station 102 is monitored by RF transceiver module 92. Awaking for monitoring of the synchronisation signal commences a timer ('Delay 6'—a time period of 40 ms) and causes incremental adjustment of counter 'N' (315) and initialisation of a binary switch 'M' (320). In the present context, counter N represents a cycle counter which is increased incrementally once per iteration of sub-process 305, and binary switch M is used to control the desired direction of sub-process 305 in the event a synchronisation procedure was successfully completed on the 20th cycle (detailed further below).

On successful receipt (310) of the coded synchronisation signal from the base station transceiver 102, assessment event 325 serves to validate the signal received and confirm that the base station 100 and the remote module 90 are indeed synchronised. If favourable, the internal clock of RF transceiver 92 is adjusted (330) so as to be in synchronisation with that of the base station 100 in accordance with the signal timing. If event 325 is unable to confirm receipt of the synchronisation signal, sub-process 360 is executed and active protective resynchronisation between the base station 100 and remote module 90 is realised (detailed further below).

Once confirmation of synchronisation is completed, RF transceiver 92 tests to determine whether the current cycle is in the 20th iteration (i.e. N=20) and whether a scheduled protective synchronisation test (see discussion on forced protective mode (FPM) below) has just been performed (i.e. M=1). In accordance with the result of assessment event 335, the system toggles back into sleep mode (340) for the remainder of the current 100 ms interval before waking again ready to receive the next expected synchronisation signal from base station transceiver 102. If the current iteration completes the 20th cycle, counter N is reset to zero (event 340).

The coded synchronisation signal is a 64 bit sequence that contains data identifying the base station transceiver and the status of controller 60. In accordance with the status, this signal may cause the wireless system to switch into operation mode, if the status indicates that the door is closing/opening, that a close/open signal has been received, or that the lock status has changed (see FIG. 6 and FIG. 7).

Successive synchronisation signals are sent in accordance with a quasi-random frequency hopping pattern known to both base station 100 and RF transceiver 92. Transmission in accordance with this pattern provides a constant guard against radio interference, thus minimising the chance of communication with the wireless system being lost. Such frequency hopping techniques per se are well known in the field of RF communication, and will not be further described here.

If, due to radio interference, no synchronisation signal is received by RF transceiver 92 at the due time, event 325 causes sub-process 360 to be executed. In this process, transceiver 92 transmits (345) an RF signal to base station 100 requesting a further synchronisation signal be sent. This is a brief (e.g. 50 μs) coded signal, including information identifying the RF transceiver, and is similar to the same short burst coded signal initially sent at commencement of the cycle. If a synchronisation signal is then duly received by RF transceiver 92 (event 350), this confirms interference-free communication, sub-process 360 is exited and the internal clock data of remote module 90 is adjusted as detailed above, and the wireless system completes sub-process 305 before switching back into sleep mode. If no synchronisation signal is received in response to the request signal 345, then a further request signal is sent by RF transceiver 92. This process is repeated until expiry of Delay 6. It will be appreciated that this criterion could also be implemented in respect of a maximum iteration count of cycles of sub-process 360. If no synchronisation signal is received by the end of this period (or number of prescribed iterations), this is deemed to indicate that synchronisation has been broken. At this point, base station transceiver 102 and RF transceiver 92 are programmed to commence a resynchronisation process (event 370), in order to re-establish synchronisation therebetween.

Resynchronisation (370) of wireless systems is generally known to the skilled reader, and will not be described in specific detail here. Importantly, resynchronisation involves the base station providing to the RF module data regarding timing and the frequency pattern to be employed for the frequency hopping. By way of brief explanation, the resynchronisation process 370 involves the base station 100 transmitting bursts of 8 RF pulses at the same frequency for about 40 μs, then listening for the following 20 μs. Each pulse has a specific byte for its identification. The frequency is changed for every consecutive burst in a random manner. The remote module 90 listens every 120 ms for about 20 μs at a random frequency. If the base station 100 and the remote module 90 frequencies coincide (i.e. during the time the base station transmits and the remote module 90 is listening), the module 90 synchronises with the base station and sends a confirmation signal during the interval that the base station is listening.

Once resynchronisation has been successfully completed, the wireless system switches back into sleep mode to continue the cycle described above.

It will be understood that the technique described above provides an effective way to ensure communication between the base station 100 and the wireless system, whilst keeping power usage of the components of the wireless system to a minimum. However, it will be noted that in accordance with this algorithm, during periods other than in operation mode, the base station 100 may never receive signals from RF transceiver 92. Whilst this may indicate that the synchronisation signals are being duly received by the RF transceiver 92 and that all is well, there is a possibility that in fact communication has been lost due to interference or failure of the wireless system, or that synchronisation has been lost. For that reason, the system is configured to switch into a forced protective mode (FPM) every 20 synchronisation cycles (or other appropriate prescribed interval). Thus, on completion of the 20th iteration of sub-process 305, assessment event 335 will affirm thereby causing a FPM cycle 338 to commence.

A core component of the FPM mode 338 is thus sub-process 360. In this mode, RF transceiver 92 transmits (at event 345) a short burst coded FPM signal, while base station 100 is programmed to detect that FPM signal (events 415/420) at that time over a set period. If the FPM signal is detected (see affirmation of event 420 in FIG. 4), the base station 100 responds (at event 425 in FIG. 5) with a prescribed FPM confirmation signal. On receipt of this confirmation signal, the system knows (i.e. by way of assessment event 325) that the communication link is open and synchronised, and the continuous synchronisation process is continued as described above.

In one form, the FPM cycle (338) is provoked by the RF transceiver 92 being programmed to wake up, on the 20th cycle, at a time to miss the transmission (405) from the base station 100. As such, non-receipt of the transmission (determined at 325) provokes execution of sub-process 360 (i.e. FPM mode). Alternatively, the base station 100 may be programmed to miss its regular transmission thereby provoking execution of sub-process 360.

As detailed above, if the FPM confirmation signal 350 is not received by the RF transceiver 92, assessment event 325 will fail causing a further short burst FPM signal to be sent to base station transceiver 102 for confirmation. Sub-process 360 repeats until the expiry of the prescribed time period (Delay 6) on repeated unsuccessful validation at assessment event 325 (measured from the time of the expected transmission by base station 100 at event 310), at which point the system will automatically initiate a complete resynchronisation process 370.

Each iteration of sub-process 360 tests to determine at event 380 whether a scheduled FPM cycle is in progress (and has not been commenced following failure to receive the schedule synchronisation signal outside of the FPM procedure). If so, counter N is reset to zero (event 385), and binary switch M is set to unity. If assessment event 325 confirms successful receipt (at 350) of the confirmation signal from the base station 100, the internal clock of RF transceiver 92 will be adjusted accordingly and sub-process 305 will be allowed to continue. It will be understood that resetting counter N to zero (385) and equating binary switch M to unity (390) during sub-process 360 on the 20th cycle ensures that FPM is not recommenced when successfully re-entering sub-process 305 following completion of the scheduled FPM cycle.

Figure 5:
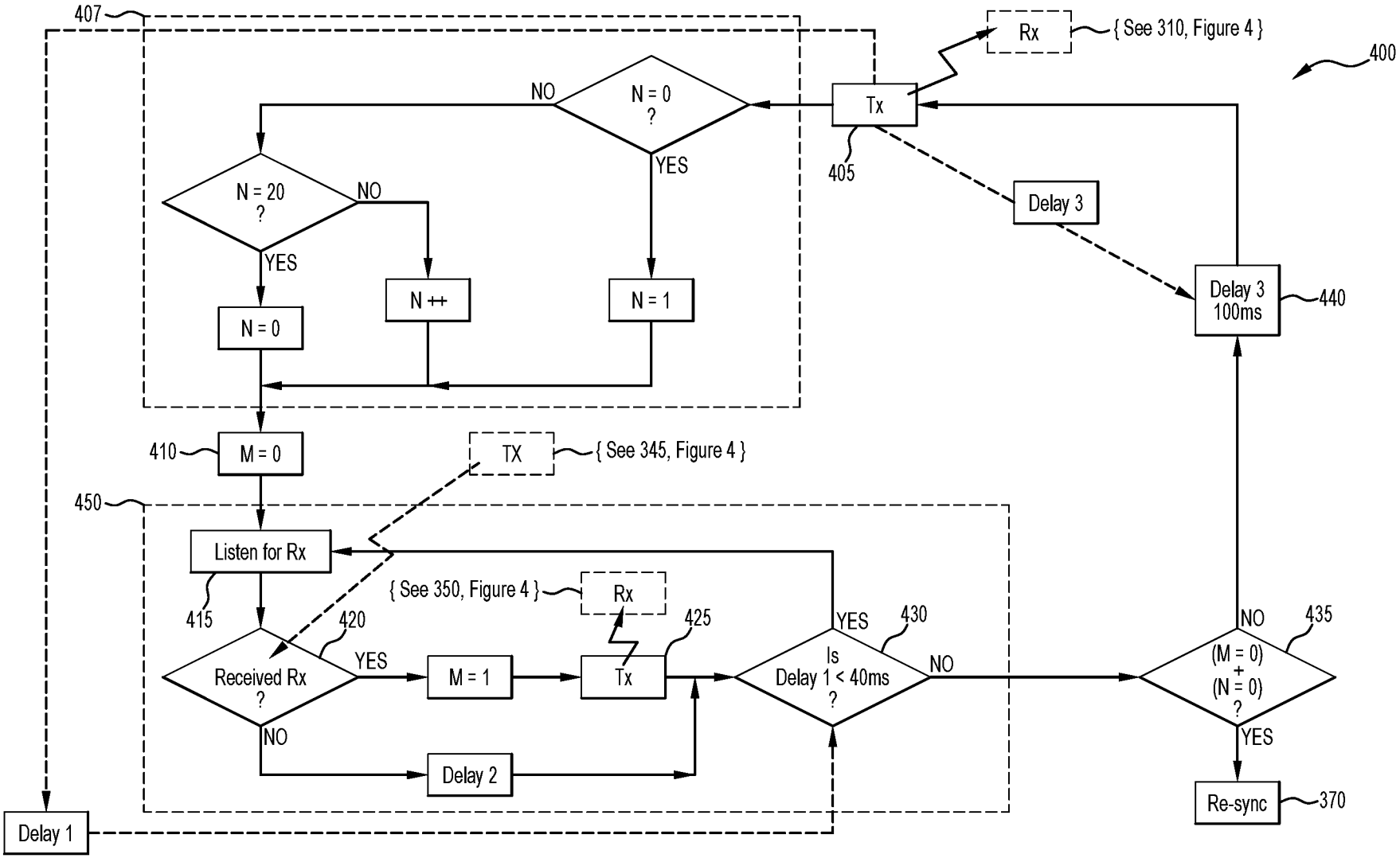
FIG. 5 is a flow diagram illustrating the synchronisation process implemented for the base station of the control system shown in FIG. 3.

FIG. 5 shows the logic algorithm 400 which represents the process programmed into transceiver 102 of the wireless base station 100 every 100 ms ('Delay 3' in FIG. 5). Each synchronisation maintenance cycle begins with base station 100 transmitting the short burst coded synchronisation signal at event 405. Following transmission (405), sub-process 407 is entered which serves to test the current state of counter N to determine where in the synchronisation maintenance regime the current iteration is. It will be understood that the value of counter N and binary switch M dictates (at event 435) when the base station 100 is to revert to a full resynchronisation regime (event 370).

The base station listens (at event 415) for a request signal sent from the remote module 84. As discussed above, such a signal (see event 345 in FIG. 4) is expected every 20 polling cycles as part of the FPM cycle. Successful receipt of such a signal is tested for at event 420.

The base station 100 continues to listen (415) for the signal until the expiry of 40 ms ('Delay 1' in FIG. 4). Once expired, the base station 100 assumes synchronisation with the transceiver module 84 remains intact and prepares to repeat the transmission (405) as soon as Delay 3 expires. The latter described process typifies operation of base station 100 for a standard iteration of sub-process 305, i.e. when N≠20. During these iterations, switch M remains zero signifying that the current cycle is a non-scheduled FPM cycle. Counter N, being non-zero during this time, causes event 435 to fail thereby allowing the process to proceed to the next polling cycle.

The above described process continues until the 20th cycle at which time a scheduled FPM cycle is executed by sub-process 305 (by way of event 338). As described above, during non-FPM cycles of sub-process 305, if synchronisation remains intact, no communication signal is received by the wireless base station 100 from the remote module 90. During an FPM cycle, assessment event 420 will confirm whether a communication signal from remote module 90 (at event 345 shown in FIG. 4) is received by base station 100. If receipt is confirmed, binary switch M is set to unity and the base station transceiver 102 transmits (at event 425) a confirmation signal to transceiver module 84 ('Delay 2' in FIG. 5). This signal is the same short burst coded synchronisation signal originally transmitted at event 405. If Delay 1 (about 40 ms) has not yet expired, events 415 and 420 are revisited but event 420 will fail given that remote module 90 has, following successful confirmation of receipt of the transmission (at event 350) at assessment event 325 (shown in FIG. 4), returned normally to complete the current iteration of sub-process 305. Thus, despite the wireless base station 100 continuing to iterate through sub-process 450 until the expiry of Delay 1, it will eventually proceed to assessment event 435 and fail (i.e. M=1, N=20) so as to continue to the next cycle as normal.

If synchronisation is lost, this will be detected during a scheduled FPM cycle. Here, the synchronisation signal transmitted by the wireless base station 100 at event 425 will not be received by the remote module 90, and will provoke a further iteration of sub-process 360 to be performed by the RF remote transceiver 92. Continued requests will be made by the remote module 90 (at event 345), all of which will be received by the wireless base station 100 (i.e. if no interference exists). Sub-processes 360 and 450 will both continue until respective Delays 6 and 1 expire (at events 365 and 430 respectively) at which point the remote module 90 will leave sub-process 360 and default to the programmed resynchronisation regime 370 (and so will cease sending signal requests). At this stage, counter N and binary switch M of process 400 will equal 20 and unity respectively, which will cause assessment event 435 to fail and provoke a further (and final) iteration of process 400 to commence. When sub-process 407 is next executed, sub-process 407 will test counter N and conclude that the 20th cycle is in progress so causing binary switch M to be set to zero (so setting both parameters to ensure that event 435 is affirmed). As the remote module 84 has by this time ceased transmission of any further request signals, assessment event 420 will fail (ensuring that M is not set to unity) and, on the expiry of Delay 1, cause affirmation of assessment event 435 thereby provoking the base station 100 to enter the programmed resynchronisation regime 370. It will be appreciated that sub-process 407 could be structured in a number of ways to ensure that counter N and binary switch M are adjusted appropriately to allow algorithms 300/400 to operate as described. For completeness of the above description of algorithms 300 and 400 shown in FIG. 4 and FIG. 5, Delay 1 and Delay 6 are equal, and relate to the protective loop of the forced protection mode (for example, 40 ms). Both Delay 3 and Delay 5 are equal and relate to the frequency of synchronisation maintenance (100 ms). Delay 2 is equal to the duration of the set transmission burst at event 425. It will be appreciated that the values of each delay could be readily varied depending on the desired system response requirements.

As described above, the system is forced into forced protective mode (FPM) after each 20 cycles of 100 ms, in order to ensure that base station 100 does not lose contact with remote module 90. In protective mode, communication unit 92 transmits a signal to be received by base station 100. If this signal is not received (despite repeated attempts via sub-process 360) within 40 ms (Delay 6), then the system has failed in protective mode and switches into resynchronisation mode (event 370).

If, despite the above-described synchronisation protocol, protective FPM operation and attempt(s) at resynchronisation 370, communication between the remote module and the base station is lost, the control system disables further operation of the door operator and provides a prescribed error message or warning for the attention of the user.

Examples of Operation of Control System and Lock Operation

Figure 6:
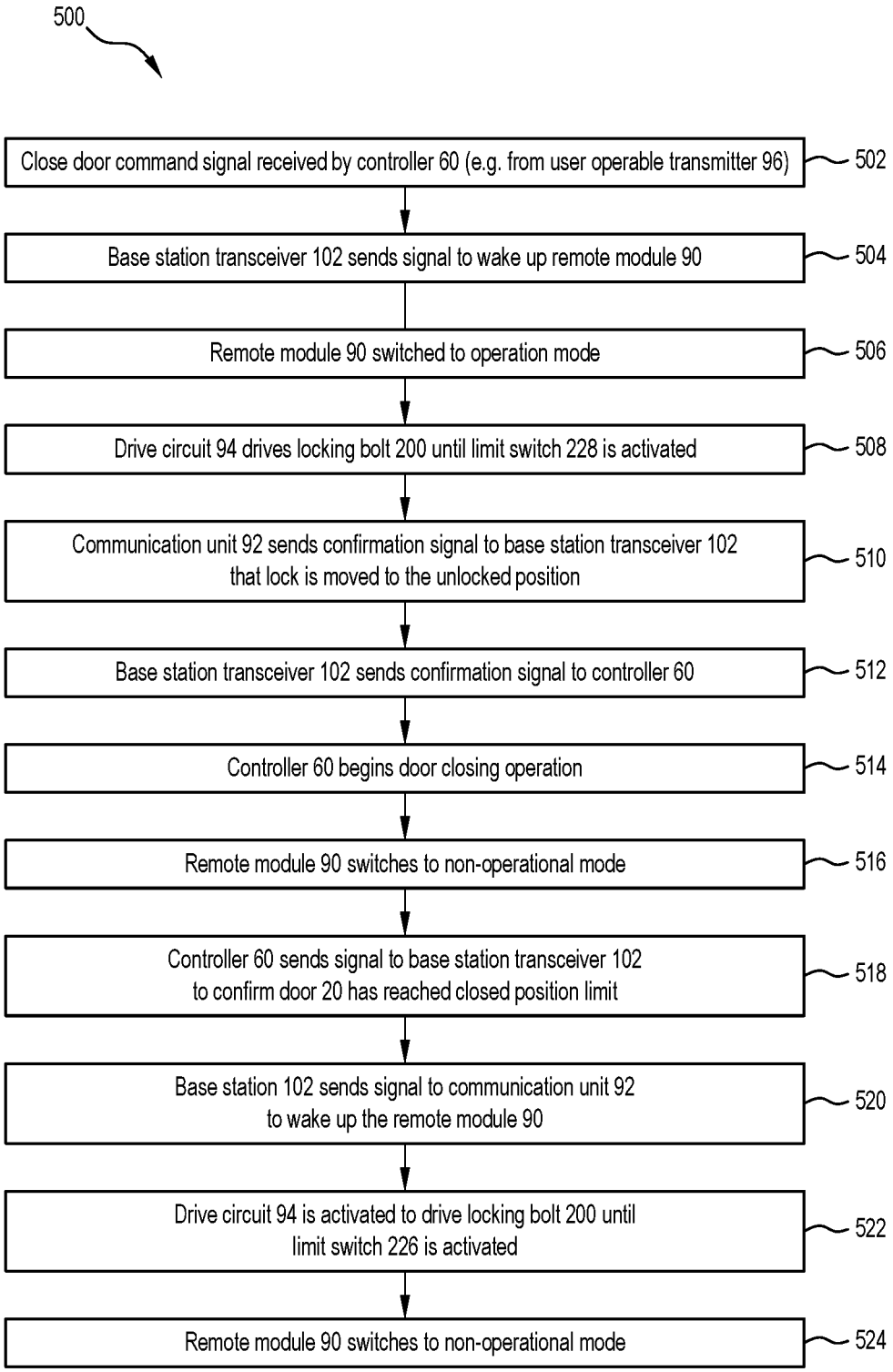
FIG. 6 is a flow diagram illustrating an example process implemented for the control system shown in FIG. 3 when a door close command is received.
Figure 7:
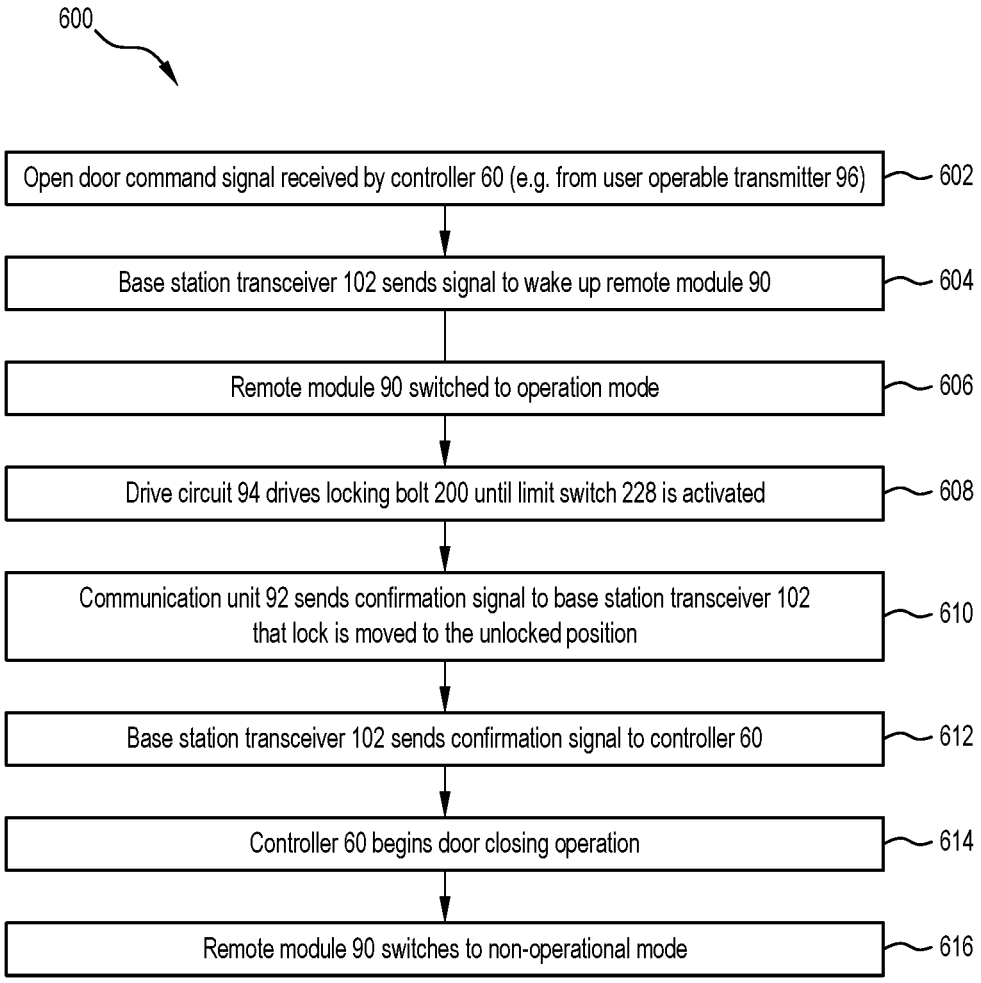
FIG. 7 is a flow diagram illustrating an example process implemented for the control system shown in FIG. 3 when a door open command is received.

FIGS. 6 and 7 show respective algorithms 500 and 600 which illustrate an implementation of the interaction between the controller 60, base station 100 and remote module 90 when the system switches to the operation mode, e.g. when a user instructs controller 60 to open or close the door. These figures do not illustrate the operation realised in the event of manual intervention of lock assembly 84, which is discussed above.

FIG. 6 illustrates method 500 for operating the control system 240 when a door close command is received.

At step 502, a door closing command is received at the controller 60, for example, from a user operable transmitter 96, or another user operable control device. The status of controller 60 is therefore switched to door closing status.

At step 504, in response to door closing command, controller 60 notifies base station transceiver 102, which in turn forwards a first activation signal to wake up remote module 90. The controller checks the lock status, and if it determines that it is not in its unlocked position, the first activation signal is encoded with a command for unlocking lock assembly 84.

At step 506, the first activation signal, once received by transceiver 92, switches remote module 90 into the operation mode, allowing two-way communication with the base station.

If the lock is in its unlocked position, the process jumps to step 514.

At step 508, lock circuitry 94 operates to drive the motor 202 in a predetermined direction to move the lock bolt 200 into the unlocked position until limit switch 228 is activated.

At step 510, in response to limit switch 228 being activated, communication unit 92 sends a confirmation signal to base station transceiver 102 which updates the lock status. This signal thus confirms that locking bolt 200 is withdrawn into its unlocked position.

At step 512, base station transceiver 102 passes a confirmation signal to controller 60. This signal indicates that it is safe to start closing door 20.

At step 514, controller 60 initiates closing operation of door 20.

At step 516, remote module 90 returns to non-operation mode. As discussed above, communication unit 92 sends a suitable signal to base station transceiver 102 during the closing operation of door 20 if bolt 200 is manually moved from its unlocked position, and the operation of door 20 is interrupted.

At step 518, door 20 reaches its fully closed position. In response, controller 60 sends a signal to base station transceiver 102.

At step 520, in response to this signal, transceiver 102 forwards a second activation signal to communication unit 92 to switch the remote module 90 into the operation mode. The second activation signal is encoded with a command for locking lock assembly 84.

At step 522, lock circuitry 94 receives the lock command and operates motor 202 until limit switch 226 is activated (i.e. the locking bolt 200 is fully extended in its locked position through the striker plate 238). This results in a signal sent to base station 100 and the lock status is updated.

At step 524, remote module 90 returns to non-operation mode.

FIG. 7 illustrates method 600 for operating the control system 240 when a door open command is received.

At step 602, a door open command is received at controller 60, for example, from a user operable transmitter 96, or another user operable control. The status of controller 60 is changed to a door opening status.

At step 604, in response to door opening command, controller 60 notifies the base station transceiver 102, which in turn forwards the first activation signal to wake up remote module 90. The first activation signal is encoded with a command for unlocking lock assembly 84, if the lock status confirms that the lock is not in its unlocked position.

At step 606, the first activation signal, once received by transceiver 92 of remote module 90, switches the remote module 90 into the operation mode.

At step 608, lock circuitry 94 operates to drive motor 202 in a predetermined direction to move lock bolt 200 into the unlocked position until limit switch 228 is activated.

At step 610, in response to activation of limit switch 228, communication unit 92 sends a signal to base station transceiver 102 to confirm that locking bolt 200 is in its unlocked position, which updates the recorded lock status.

At step 612, base station transceiver 102 sends a confirmation signal to controller 60. This signal indicates that it is safe to start opening door 20.

At step 614, controller 60 initiates opening operation of door 20 until it reaches its open position.

At step 616, the remote module 90 returns to its non-operation mode. This may happen immediately after step 610.

It will be understood from the above that wireless remote module 90 will be in its sleep mode for the majority of the time, hence minimising power usage as much as possible. This operation is effective because (a) wireless base station 100 and wireless lock assembly 84 are always within range of each other (unlike, for example, an RF remote control working with a vehicle or premises access control unit), and (b) the base station is mains powered, and hence its RF transceiver can be continuously monitoring for signals from wireless lock assembly 84. Intermittent switching from sleep mode into a standby mode to monitor synchronisation signals from base station 100 provide continuous low power synchronisation over the wireless link, thus assisting in minimising dangers of interference. For a test system developed by the present applicant in accordance with the invention, it has been calculated that under normal usage the system will afford a battery life of five years or more with lock assembly 84 using 2×C type batteries.

Remote module 90 may be programmed to return to its non-operation mode after commencing operation of the lock drive (i.e. at steps 508 and 608), switching back into operation mode only when the limit switch operates signifying the end of travel (or, alternatively, after the expected travel time 700 ms), so to consume even lower power. However, it is preferred that it remain in operation mode during lock operation.

In an alternative to the system described above, the RF link between base station 100 and remote module 90 of lock assembly 84 may be replaced by another form of wireless communication, such as an IR link. This reduces problems of interference, but requires line of sight communication, which may not be practicable in many situations.

Remote and Network Monitoring and Control of Door Operation

The description above discusses user 'door open' and 'door close' commands received by controller 60 from a remote control transmitter, of the sort often integrated into a key fob, when used with a garage door or gate, kept by the user conveniently in a vehicle which uses the garage.

Alternatively, the command signals may be provided from a user interacting with a computer application on a smartphone or other mobile electronic device. It is becoming more common for home access and home security systems to include functionality to allow remote monitoring and control of different aspects by users via network access. Applicant's copending application International Patent Application No PCT/AU2015/050625 entitled 'Remote monitoring and control for a barrier operator' discloses such a system. The system disclosed includes a gateway device connecting controllers of barrier operators (i.e. one or more doors, gates, etc.) to a computer network, the gateway device operating as a hub for the barrier operators, via which monitoring signals and control and command signals are routed. Once connected to the network, the barrier operators can be remotely monitored and controlled in a secure manner. The gateway device is configured to set up and configure the barrier operators, to send control signals to the barrier operators for controlling their operation, and to receive monitoring data therefrom.

The present invention may be integrated into such a networked monitoring and control system. As well as receiving closure operation commands via the system, it may be used to communicate issues, reports and alerts to users (and/or to service personnel) via a user interface, e.g. a GUI on the user's mobile electronic device. The user interface may provide, in addition to an indication of door status (closing closed, opening, open), an indication of lock status (locked, unlocked). A suitable alert may be sent in the case of remote module 90 low battery condition, and/or in the event of failure to unlock or lock a lock assembly when commanded by the base station, and/or in the event of manual operation of the lock assembly 84 triggering a change of state signal transmitted to base station 100, in particular if such a condition interrupts the operation of the closure.

Installation and Setup of Lock Assembly

In set up, the system is preferably configured such that the base station automatically establishes communications with remote module 90 and thus registers the or each lock assembly 84 for use. To this end, the lock assembly should be powered up (i.e. batteries installed) before the closure operator is initiated. Typically, the installer will first set up controller 60 for operation with closure 20 (including setting the travel end limits), and will then initiate base station 100 to set up communication with controller 60. Base station 100 will also initiate and set up synchronised wireless communication with remote module 90, which can be realised through initiating the synchronised communication protocol detailed above.

Further, the system is configured such that when a base station 100 is connected to controller 60, no modification or re-initiation is necessary, the two units are immediately able to work together. If the lock assembly of the invention is retrofitted to (or replaced in) an existing closure system it is necessary to re-initiate the closure operator, and controller re-initiation is necessary if a base station or a lock assembly 84 is removed.

Use of Multiple Locks

As discussed above, the system of the invention can be used with two or more lock assemblies, and each one may communicate independently with the base station (or, alternatively, the remote modules may be arranged in a master/slave relationship. For roller doors, it is generally necessary to use a lock on each side of the door, as such a door has sufficient flexibility to allow a person attempting unauthorised access to force up just one side of the door.

When two or more locks are used, separate synchronisation signals are sent from the base station to each of the remote modules of the respective locks. This may be done by interleaving the synchronisation signals in time (time allocation or time division), or another method of allocation (e.g. frequency or code division) may be used. Each signal sent to or from each remote module includes identification data for the remote module and for the base station.

With multiple locks, the control system logic determines whether all lock assemblies associated with a particular closure are in the unlocked condition before moving that closure, and an alert signal may be generated when any of the lock assemblies associated with a particular closure fail to lock or unlock in response to a command sent from the base station.

Use with Other Devices in Door System

The lock assembly of the invention may be used as a peripheral device in a closure control system along with other peripheral devices. For example, when used with a garage door, the door may also be equipped with an obstruction detection system, such as a PE beam system, preventing or stopping operation of the garage door when the beam is broken. The obstruction detection system may include one or more wireless obstruction detection remote modules communicating with the same base station which communicates with remote module 90, with programmed logic ensuring continuous synchronised communication with each remote module. Alternatively, an obstruction detection module may be configured as a peripheral device to a lock assembly remote module, or vice versa, with one module effectively controlling operation of the other.

Alternative Embodiment of Lock Assembly

Figure 8A:
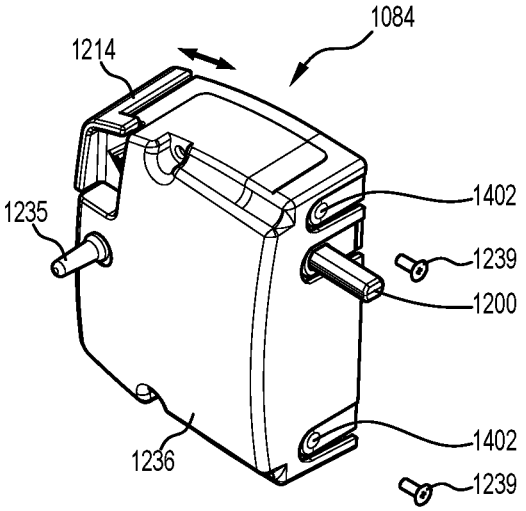
FIGS. 8A to 8D illustrate a further embodiment of the lock assembly, including the mounting of the assembly to a sectional overhead garage door.

An alternative embodiment of the lock assembly 84 is illustrated in FIG. 8A, in which like components to those described and illustrated with reference to FIG. 2 are given the same reference number, but raised by 1000.

In this variant, lock assembly 1084 features an electric motor and geared drive (not shown) driving projecting locking bolt 1200 between a first, locked position and a second, unlocked position. Once again, microswitches (not shown) cooperating with the shaft of bolt 1200 are employed to provide a signal when the first or second position is reached. When bolt 1200 is between the first and second positions it can be seen as being in its third, intermediate position. The componentry of lock assembly 1084 is mounted to a base part (not shown) and protected within housing 1236, removably fastened to the base part by screws.

In this embodiment, manual operation is realised by handle 1214 mounted to the end of the bolt shaft opposite to the end where bolt 1200 projects, which as shown is external of housing 1236. As in the first embodiment, although not visible in FIG. 8, a portion of lock assembly 1084 within housing 1236 is provided for enclosing module 90, being the electrical and electronic componentry of the device (lock circuitry 94 and communication unit 92—FIG. 3). In FIG. 8A a suitable shaping 1235 in housing 1236 is shown, enclosing a projecting antenna of communication unit 92.

An advantage of this embodiment is that no removal of housing 1236 or disassembly of the lock assembly is required in order to manually override the unit manual by way of handle 1214. However, this raises the risk of unexpected manual interference, and the system is configured such that any change of state recorded at base station 100 results in stopping the door if it is moving (or preventing the door from moving if an open or close command is received). In such a situation, a warning may be provided (e.g. a flashing light and/or audible signal), and only when the lock is moved into the locked or unlocked position as required, and a further command signal received, will a door move operation be recommenced. For example, if the door is moving from its open position to its closed position (with the lock in its second position), and the lock is manually moved, a signal is sent to base station 100 and the door motor is stopped. When a further command signal is sent to close the door, a signal is first sent to remote module 90 to move the lock into its second, unlocked position, and the door movement is then commenced. If, instead, before the further command signal is sent, the lock is manually moved into its second position, then this new state is signalled to the base station so that the door is ready to move on receipt of the further command.

Figure 8B:
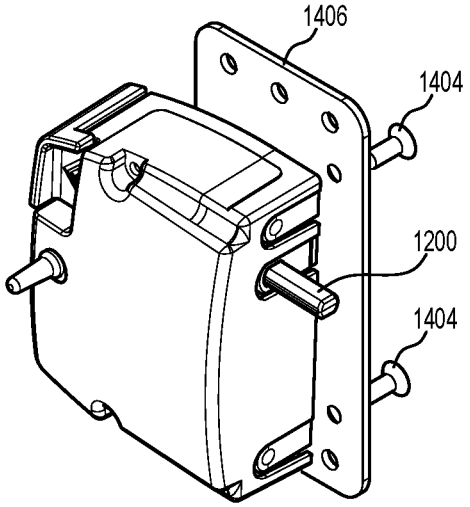

FIG. 8A shows screws 1239 for use in mounting lock assembly 1084 to door track 1080*b* by way of threaded bores 1402, in a similar way to the arrangement illustrated in FIG. 2C. In FIG. 8B an alternative mounting arrangement is shown, in which a mounting plate 1406 is fastened to threaded bores (not shown) in the rear of base part of lock assembly 1084 by way of screws 1404, so to allow mounting of the assembly to the door itself. This option is suitable for overhead door applications, for example, particularly in installations in which there is insufficient side room to accommodate the lock assembly laterally of door track 1080*b*.

Figure 8C:
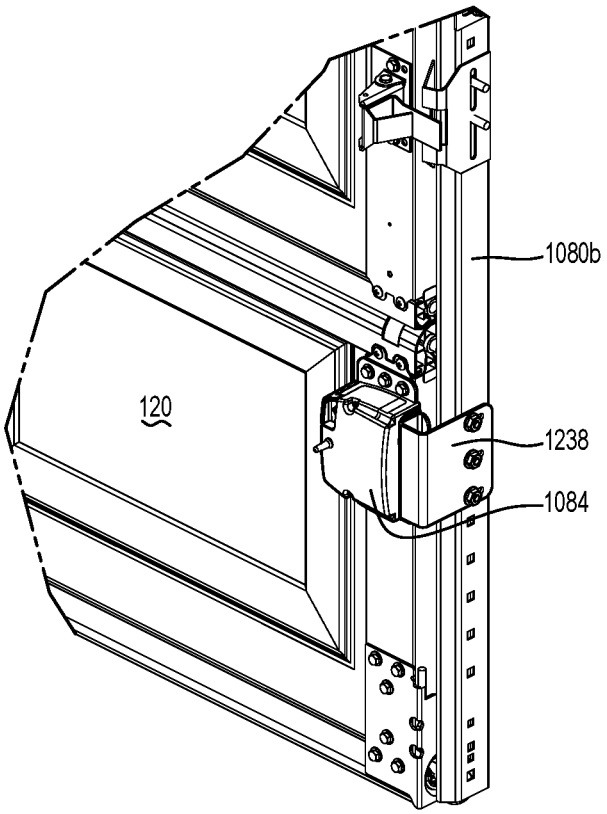
Figure 8D:
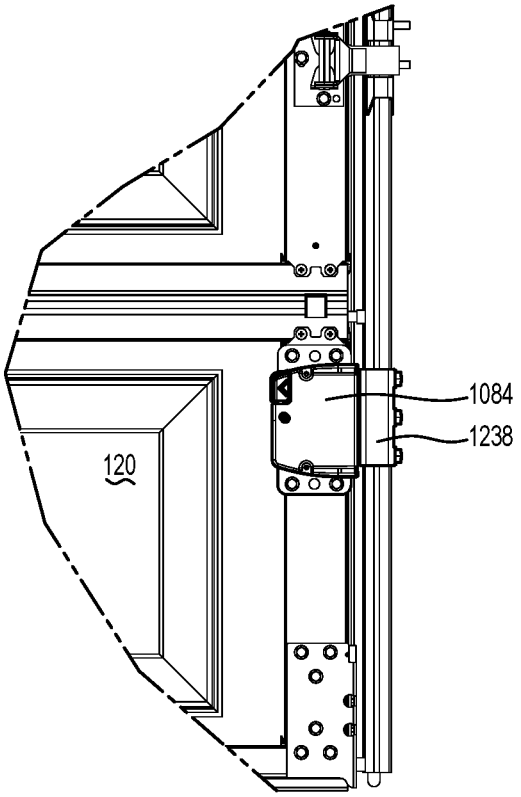

FIGS. 8C and 8D shows the assembly mounted at one edge of the lower section of a sectional overhead door 1020, by fastening mounting plate 1404 to the door by bolts or similar as shown. A complementary strike plate 1238 of a suitable configuration is mounted to the outside of track 1080*b* by a set of bolts as shown, to cooperate with locking bolt 1200.

As shown in FIGS. 8C and 8D, lock assembly 1084 is used on the right hand side of door 120. To use the lock (or a second lock) on the left hand side of the door a left hand version of the lock assembly can be used, i.e. a mirror image of the design shown in FIG. 8A. Preferably, to simplify design, manufacture and stock control, an identical lock assembly is used, inverted for use on the left hand side of the door, with the bolts simultaneously moving in opposed directions into their locking positions on the two sides of the door. For convenience, handle 1214 is brightly coloured (e.g. red) so that it can easily be identified in the event manual operation is required.

Further Alternative Embodiment of Lock Assembly

Figure 9:
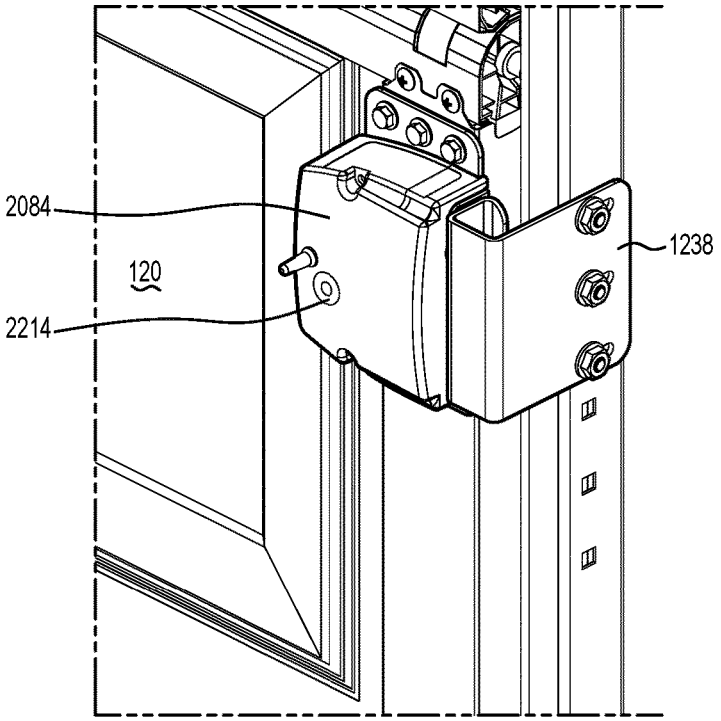
FIG. 9 illustrates a further embodiment of the lock assembly, similarly mounted to a garage door.

FIG. 9 illustrates a further variant, in which like lock assembly components to those described and illustrated with reference to FIGS. 8A to 8D are given the same reference numbers, but raised by 1000.

In a similar way to FIG. 8C, this shows a limited sideroom installation, with lock assembly 2084 mounted to the door 120 via a mounting plate, to engage with strike plate 1238.

Lock assembly 2084 omits handle 1214, which simplifies the mechanical components. Instead, for use in emergencies (such as in case of a power outage), a push button 2214 accessible on the front face of the housing as shown enables manual operation of the lock assembly. Push button 2214 is connected to the drive circuitry, which is programmed such that each push of the button results in movement of the locking bolt (not shown) between from the locked to the unlocked position, and vice versa.

Apart from reducing the number of parts and allowing use of a closed housing, which is less vulnerable to dirt and dust, this embodiment reduces the likelihood of the lock being placed in an intermediate position, i.e. bolt positions between the locked and unlocked positions.

Base station 100 is programmed such that, when the recorded lock status of the lock assembly indicates that the lock battery voltage is below a prescribed threshold (e.g. below 2.4 v for a 3 v power source, BATTERY STATUS=LOW), a command is sent to the lock assembly to prevent manual operation between the unlocked and locked position. In other words, operation of push button 2214 will not result in locking the door, thus avoiding the situation that the door is locked and the lock battery is not sufficient to allow a user to unlock the door.

Every operation of the door when the lock status indicates a low battery results in a suitable status indication accompanied by an audible and/or visual warning signal (such as a programmed sequence of warning flashes of the operator light and, if incorporated in a networked system, a signal to the user's mobile electronic device).

Further, the system can be configured for 'failsafe' operation, such that when the BATTERY STATUS is recorded as LOW and the door is locked, the lock is moved into its unlocked position until the battery is replaced. This prevents the risk that the door cannot be manually opened in the event of a power failure or operator malfunction. This failsafe design therefore ensures that the lock is always in its unlocked condition when the battery charge is low.

It will be understood that when the BATTERY STATUS is recorded as LOW but the communication between base station and remote module is still operating, and the lock is recorded in its unlocked condition, the door can still be opened and closed (but the lock will not operate). When communication with the remote module fails, or the lock is not in its unlocked condition, door operation is precluded.

When a mains power failure occurs, the lock assembly will remain in the state it finds itself when the power failure occurs. Therefore the power interruption will not affect the status of the lock assembly. During the power failure the lock assembly can be operated by push button 2214 as normal, and when power is restored the current lock status can be reported to base station 100.

In this embodiment, remote module 90 includes the logic functions that enable it to drive the lock between the locked and unlocked positions on receiving signals from push button 2214.

It is noted that FIGS. 10 and 11, described above with reference to examples of mounting of the lock assembly to a roller door track, illustrate the use of a lock 2084 of the type comprising a manual push button 2214.

Additional Features

Lock assembly 84, 1084, 2084 may be provided with an additional keylock as part of the mechanism, to enable a user equipped with the key to selectively lockout remote operation of the lock (e.g. to prevent unlocking of the lock assembly when going on vacation).

It will be understood that the control system may be configured to control any suitable number of lock assemblies mounted at different positions on one or both roller tracks 80*a*, 80*b* of the door 20.

Further, it will be understood that, although the above embodiments described above use a locking bolt that drives between an unlocked and a locked condition, the invention is equally applicable to any other suitable lock assembly, such as a pivoting latch assembly, or an electromagnetic lock assembly. For example, the invention may be used with a latch lock on a door, i.e. a lock which automatically engages when the door or other closure is moved to its closed position, usually through engagement of a spring-loaded bevelled bolt interacting with a strike plate when closing the door. In this form, the remote module may operate to selectively withdraw the bolt against the spring for a limited time to allow opening, and then release the bolt such that subsequent closure will re-engage it.

Further, it will be understood that while the above description refers to use of the invention with garage doors, it is equally applicable to any type of closure, such as a gate, curtain, shutter, barrier, which may open and close by any type of operation, e.g. sliding, retracting or swinging on hinges. The invention may, for example, be used for parcel or letter boxes on a premises, operation of the wireless lock being commanded by control signals from a base station receiving commands to unlock the box in response to prescribed instructions or conditions.

The word 'comprising' and forms of the word 'comprising' as used in this description do not limit the invention claimed to exclude any variants or additions.

Modifications and improvements to the invention will be readily apparent to those skilled in the art. Such modifications and improvements are intended to be within the scope of this invention.

What is claimed is:

1. A lock assembly for controlling a locking element for a closure, the closure arranged to move between a closure open position and a closure closed position in response to closure open commands and closure close commands, the lock assembly having or associated with a lock mechanism for moving the locking element between a locked condition and an unlocked condition, the lock assembly having a communication unit configured to wirelessly communicate with a base station coupled to a closure controller, the closure controller receiving said closure open commands and said closure close commands, the base station arranged to send lock control signals to the lock assembly to operate the locking element, the lock assembly being arranged to have at least an operation mode and a non-operation mode, in which power consumption of the lock assembly in the non-operation mode is lower than that in the operation mode, the lock assembly being configured to switch between the non-operation mode and the operation mode based on instruction from the base station, wherein, in the non-operation mode, the communication unit maintains a communication link with the base station based on a pre-established synchronization protocol, and wherein when the closure is in said closure open position and a closure close command is received by the closure controller the locking element, if it is in the locked condition, is moved from the locked condition to the unlocked condition, and wherein when the closure reaches the closure closed position the lock assembly moves the locking element from the unlocked condition to the locked condition.

2. The lock assembly of claim 1, arranged to have at least three modes of power usage, including:

the operation mode in which the communication unit is active for two-way communication with the base station, and the lock mechanism can be actuated to operate the locking element, a first non-operation mode being a standby mode, in which the communication unit is active only to receive communications from the base station;

a second non-operation mode being a sleep mode, in which the communication unit is inactive; and wherein the lock assembly is configured to switch between the operation mode, standby mode and sleep mode in accordance with a pre-established protocol.

3. The lock assembly of claim 2, for use with a base station configured to transmit first synchronization signals at first prescribed intervals, wherein the lock assembly is programmed such that, when in sleep mode, it switches for a preset duration to the standby mode at or substantially at the first prescribed intervals to detect the first synchronization signals, thereby to monitor a communication link between the base station and the lock assembly.

4. The lock assembly of claim 3, further configured such that, if it does not detect a synchronization signal from the base station, the lock assembly sends a request signal to the base station requesting re-transmission of another synchronization signal.

5. The lock assembly of claim 4, further configured such that, if no synchronization signal is received within a set time period from sending the request signal, the lock assembly sends one or more further request signals to the base station and, upon failure to receive a synchronization signal, the lock assembly commences a resychronization procedure to re-establish synchronized communication with the base station.

6. The lock assembly of claim 1, wherein timing control of switching of the lock assembly between the non-operation mode and the operation mode is provided by a lock assembly timer, and the lock assembly is configured such that, upon detection of a synchronization signal from the base station, timing of transmission of the synchronization signal is used to adjust the lock assembly timer.

7. The lock assembly of claim 1, in combination with a base station for communicating with the communication unit of the lock assembly, wherein the lock assembly is configured to transmit lock assembly check signals at second prescribed intervals, and wherein the base station is configured to detect the lock assembly check signals at or approximately at the second prescribed intervals.

8. The lock assembly of claim 7, wherein the base station is further configured such that, when it receives a lock assembly check signal, it transmits a confirmation signal, and if this confirmation signal is received by the lock assembly within a prescribed time period from transmission of the lock assembly check signal, the lock assembly switches to the non-operation mode.

9. The lock assembly of claim 7, wherein the base station is configured to transmit first synchronization signals at first prescribed intervals, and wherein further each of the first prescribed intervals is one repeated time interval and, preferably, each of the second prescribed intervals is a multiple of the one repeated time interval.

10. The lock assembly of claim 1, further configured such that, if the lock assembly receives a signal from the base station signifying a particular closure controller status, it switches to the operation mode.

11. The lock assembly of claim 1, configured to transmit a locking element status signal to the base station concerning whether the locking element is in the locked condition or the unlocked condition, to be stored by the base station.

12. The lock assembly of claim 1, wherein, when the locking element departs from its locked or its unlocked condition, a signal is transmitted by the lock assembly to the base station and stored as a different status.

13. The lock assembly of claim 1, wherein the locking element is provided with a manual operator.

14. The lock assembly of claim 13, further configured such that if the manual operator is operated and the lock assembly is not in the operation mode, the lock assembly switches into the operation mode and transmits a signal to the base station to be stored as a locking element status.

15. The lock assembly of claim 1, further configured such that, if the base station sends a lock control signal to the lock assembly to operate the locking element, and does not receive a corresponding locking element status update within a prescribed time, a prescribed action is performed.

16. The lock assembly of claim 1, configured to transmit information concerning its power source status.

17. A control system for locking a closure, comprising two or more lock assemblies of claim 1, arranged to communicate with a common base station.

18. A control system for a lock for a closure, the control system comprising:

a lock assembly having or associated with a lock mechanism for operating the lock, the lock assembly having a communication unit and a replaceable power source which powers the lock mechanism and the communication unit; and a base station coupled to a controller of the closure, and configured to communicate with the communication unit, the base station being programmed such that, when initiated, it determines whether the communication unit of a lock assembly having the replaceable power source is present and, if so, establishes a synchronized communication link therewith.

19. The lock assembly of claim 1, in combination with a closure operator, to enable locking of the closure in a closed position by way of the lock mechanism.

20. A lock assembly of claim 1, for operating to lock a closure provided in a fixed structure, the lock assembly mountable on the closure itself, for interaction with a part of the fixed structure.

21. A closure system including two lock assemblies in accordance with claim 1, the lock assemblies for use on opposed sides of a closure to prevent movement of the closure, wherein the lock assemblies are of like form and one is inverted so that its lock mechanism operates for locking action in the opposite direction to the other.

22. A system for controlling a closure, including a lock assembly for controlling a locking element for the closure and closure controller for controlling movement of the closure, the closure arranged to move between a closure open position and a closure closed position in response to closure open commands and closure close commands received by the closure controller, the lock assembly arranged to move the locking element between a locked condition and an unlocked condition, the lock assembly having a communications unit, the closure controller coupled to a base station configured to wirelessly communicate with the communications unit, the base station arranged to send lock control signals to the lock assembly to operate the locking element in accordance with a status of the closure controller, the lock assembly being arranged to have an operation mode, a standby mode and a sleep mode, wherein, in the operation mode, the communication unit is active for two-way communication with the base station, and the lock assembly can be actuated to operate the locking element, wherein, in the standby mode, the communication unit is active only to receive communications from the base station, wherein, in the sleep mode, the communication unit is inactive, the lock assembly being configured to switch between the operation mode, standby mode and sleep mode in accordance with a pre-established synchronization protocol, and wherein when the closure is in said closure open position and a closure close command is received by the closure controller the lock assembly moves the locking element, if it is in the locked condition, is moved from the locked condition to the unlocked condition, and wherein when the closure reaches the closure closed position the lock assembly moves the locking element from the unlocked condition to the locked condition.

* * * * *